US012768111B2

(12) United States Patent
Takahashi

(10) Patent No.: US 12,768,111 B2
(45) Date of Patent: Oct. 20, 2026

(54) TISSUE PAPER AND METHOD FOR MANUFACTURING TISSUE PAPER

(71) Applicant: DAIO PAPER CORPORATION, Ehime (JP)

(72) Inventor: Sachiko Takahashi, Ehime (JP)

(73) Assignee: DAIO PAPER CORPORATION, Ehime (JP)

( * ) Notice: Subject to any disclaimer, the term of this patent is extended or adjusted under 35 U.S.C. 154(b) by 244 days.

(21) Appl. No.: 18/260,806

(22) PCT Filed: Mar. 28, 2022

(86) PCT No.: PCT/JP2022/014780

§ 371 (c)(1),
(2) Date: Jul. 10, 2023

(87) PCT Pub. No.: WO2022/254913

PCT Pub. Date: Dec. 8, 2022

(65) Prior Publication Data

US 2024/0052576 A1 Feb. 15, 2024

(30) Foreign Application Priority Data

Jun. 3, 2021 (JP) ..... 2021-093671

(51) Int. Cl.
*D21H 27/00* (2006.01)
*A47K 10/16* (2006.01)
(Continued)

(52) U.S. Cl.
CPC ..... *D21H 27/005* (2013.01); *A47K 10/16* (2013.01); *D21F 5/181* (2013.01); *D21H 21/14* (2013.01)

(58) Field of Classification Search
CPC ..... D21H 27/005; D21H 21/14; D21H 21/22; D21H 27/002; D21F 5/181; A47K 10/16
See application file for complete search history.

(56) References Cited

U.S. PATENT DOCUMENTS 4,064,213 A * 12/1977 Lazorisak ..... D21H 21/146 427/155
5,575,891 A * 11/1996 Trokhan ..... D21H 17/72 162/173
(Continued)

FOREIGN PATENT DOCUMENTS

EP 2633991 B1 * 9/2015 ..... B31F 1/122
EP 3351153 7/2018
(Continued)

OTHER PUBLICATIONS

Office Action dated Mar. 18, 2025 issued with respect to the Japanese Patent Application No. 2021-093671 with machine translation.
(Continued)

*Primary Examiner* — Jose A Fortuna
(74) *Attorney, Agent, or Firm* — IPUSA, PLLC

(57) ABSTRACT

Tissue paper containing a softener, and having a dry tensile strength of 200 cN/25 mm or greater and 400 cN/25 mm or less in a longitudinal direction, a proportional limit tensile stress of 160 cN or greater and 250 cN or less in the longitudinal direction, and a displacement of 2.4% or greater at 150 cN is provided.

7 Claims, 14 Drawing Sheets

(51) Int. Cl.
*D21F 5/18* (2006.01)
*D21H 21/14* (2006.01)

(56) References Cited

U.S. PATENT DOCUMENTS

| | | | | |
|---|---|---|---|---|
| 7,785,443 | B2 * | 8/2010 | Hermans | D21H 27/002 162/158 |
| 7,850,823 | B2 * | 12/2010 | Chou | D21F 5/181 162/158 |
| 8,246,781 | B2 * | 8/2012 | Ringold | C08G 73/0286 162/111 |
| 8,506,755 | B2 * | 8/2013 | Soerens | D21H 21/146 162/168.7 |
| 8,679,295 | B2 * | 3/2014 | Druecke | D21H 21/146 162/111 |
| 8,834,678 | B2 * | 9/2014 | Druecke | D21H 27/002 162/158 |
| 9,182,271 | B2 * | 11/2015 | Grigoriev | G01N 29/036 |
| 9,611,590 | B2 * | 4/2017 | Ringold | D21H 17/72 |
| 9,945,076 | B2 * | 4/2018 | Choi | D21H 21/146 |
| 10,161,083 | B1 * | 12/2018 | Lang | D21H 27/002 |
| 10,550,521 | B2 * | 2/2020 | Koroki | D21H 17/14 |
| 10,570,568 | B2 * | 2/2020 | Yasui | D21H 27/00 |
| 10,731,299 | B2 * | 8/2020 | Koroki | D21H 23/14 |
| 10,844,549 | B2 * | 11/2020 | Yasui | A61K 8/345 |
| 11,053,641 | B2 * | 7/2021 | Tan | D21H 17/36 |
| 11,982,055 | B2 * | 5/2024 | Dhawan | C08L 79/02 |
| 12,111,644 | B2 * | 10/2024 | Von Drasek | D21G 9/0054 |
| 2004/0221975 | A1 * | 11/2004 | Hernandez-Munoa | D21H 27/00 162/158 |
| 2004/0231812 | A1 | 11/2004 | Hernandez-Munoa | |
| 2008/0257507 | A1 * | 10/2008 | Campbell | D21H 17/55 162/111 |
| 2012/0168103 | A1 * | 7/2012 | White | D21H 27/002 162/207 |
| 2013/0032302 | A1 * | 2/2013 | Sullivan | D21H 23/60 162/111 |
| 2015/0101410 | A1 * | 4/2015 | Grigoriev | G01H 13/00 73/579 |
| 2015/0122433 | A1 * | 5/2015 | Ringold | C08L 79/02 162/111 |
| 2016/0090692 | A1 | 3/2016 | Eagles et al. | |
| 2016/0168798 | A1 * | 6/2016 | Choi | D21H 27/002 162/111 |
| 2016/0230344 | A1 * | 8/2016 | White | D21H 21/146 |
| 2017/0204565 | A1 * | 7/2017 | Ringold | C08L 79/02 |
| 2017/0314206 | A1 | 11/2017 | Sealey, II et al. | |
| 2018/0094387 | A1 * | 4/2018 | Lang | D21H 17/33 |
| 2018/0258592 | A1 * | 9/2018 | Yasui | D21H 27/00 |
| 2018/0282948 | A1 * | 10/2018 | Koroki | D21H 17/55 |
| 2019/0360154 | A1 | 11/2019 | Eagles et al. | |
| 2020/0002895 | A1 * | 1/2020 | Koroki | D21H 17/55 |
| 2020/0032459 | A1 * | 1/2020 | Yasui | A47K 10/16 |
| 2020/0240085 | A1 * | 7/2020 | Margo Moreno | D21H 27/002 |
| 2021/0040695 | A1 * | 2/2021 | Yoshida | D21H 21/24 |
| 2022/0106740 | A1 | 4/2022 | Tomioka et al. | |
| 2023/0383470 | A1 * | 11/2023 | Takahashi | D21H 17/00 |
| 2024/0052576 | A1 * | 2/2024 | Takahashi | D21H 21/22 |
| 2024/0076835 | A1 * | 3/2024 | Takahashi | D21F 11/14 |
| 2024/0084513 | A1 * | 3/2024 | Takahashi | D21H 21/22 |
| 2024/0150967 | A1 * | 5/2024 | Dhawan | C08G 73/0286 |
| 2025/0044776 | A1 * | 2/2025 | Von Drasek | G05B 19/41875 |

FOREIGN PATENT DOCUMENTS

| | | | | |
|---|---|---|---|---|
| EP | 3351153 | A1 * | 7/2018 | A47K 10/16 |
| EP | 3357386 | | 8/2018 | |
| EP | 3357386 | A1 * | 8/2018 | A47K 10/16 |
| EP | 3520663 | A1 * | 8/2019 | A47K 10/16 |
| EP | 3351153 | B1 * | 11/2020 | A47K 10/16 |
| EP | 3760088 | A1 * | 1/2021 | A47K 10/16 |
| EP | 3520663 | B1 * | 8/2021 | A47K 10/16 |
| EP | 4019698 | A1 * | 6/2022 | D21H 27/30 |
| EP | 3804592 | B1 * | 8/2023 | D21H 27/002 |
| EP | 4253652 | A1 * | 10/2023 | D21H 21/146 |
| EP | 4349227 | A1 * | 4/2024 | D21H 27/005 |
| EP | 4349228 | A1 * | 4/2024 | A47K 10/16 |
| EP | 4349229 | A1 * | 4/2024 | D21F 5/181 |
| JP | 2006-525432 | | 11/2006 | |
| JP | 2010-259706 | | 11/2010 | |
| JP | 2014-524520 | | 9/2014 | |
| JP | 2017064192 | A * | 4/2017 | A47K 10/16 |
| JP | 2018-057691 | | 4/2018 | |
| JP | 2019-150136 | | 9/2019 | |
| JP | 2019150136 | A * | 9/2019 | A47K 10/16 |
| JP | 2020-124339 | | 8/2020 | |
| JP | 2020-182741 | | 11/2020 | |
| JP | 2020-203111 | | 12/2020 | |
| JP | 2022185814 | A * | 12/2022 | A47K 10/16 |
| TW | 201619470 | | 6/2016 | |
| WO | WO-2022254913 | A1 * | 12/2022 | D21H 27/005 |
| WO | WO-2022254920 | A1 * | 12/2022 | A47K 10/16 |
| WO | WO-2022254921 | A1 * | 12/2022 | A47K 10/16 |

OTHER PUBLICATIONS

International Search Report for PCT/JP2022/014780 mailed on May 31, 2022.

Office Action dated Jul. 1, 2025 issued with respect to the Japanese Patent Application No. 2021-093671 with machine translation.

Office Action dated May 27, 2025 issued with respect to the corresponding Taiwanese Patent Application No. 111119407.

Office Action dated Mar. 18, 2025 issued with respect to the Japanese Patent Application No. 2021-093670 with machine translation.

International Search Report for PCT/JP2022/015175 mailed on May 31, 2022.

Office Action dated Aug. 12, 2025 issued to related U.S. Appl. No. 18/260,991.

* cited by examiner (A)

(B)

(C)

100
46
42
42
47
47
42
42
42

TISSUE PAPER AND METHOD FOR MANUFACTURING TISSUE PAPER

TECHNICAL FIELD

The present invention relates to tissue paper and a method for manufacturing tissue paper.

BACKGROUND ART

Tissue paper contains a softener for softening the paper. Moreover, tissue paper has a predetermined tensile strength in order not to be torn (for example, see Japanese Laid-open Patent Publication No. 2020-182741 (Patent Document 1)).

RELATED-ART DOCUMENTS

Patent Documents

Patent Document 1: Japanese Laid-open Patent Publication No. 2020-182741

SUMMARY OF THE INVENTION

Problem to be Solved by the Invention

In recent years, needs for soft tissue paper have been increasing. Increasing the amount of the softener to be added, on the contrary, does not make tissue paper soft, because the paper fails to stick to a dryer during drying and because this, in turn, makes the paper difficult to crepe. Reducing tensile strength makes the paper soft, but makes the paper more likely to be torn. Hence, there is a limit to the extent that softness of existing tissue paper could be improved.

It is an object of the present invention to provide tissue paper having excellent softness.

Means to Solve the Problem

Tissue paper according to an embodiment of the present invention contains a softener, and has a dry tensile strength of 200 cN/25 mm or greater and 400 cN/25 mm or less in a longitudinal direction, a proportional limit tensile stress of 160 cN or greater and 250 cN or less in the longitudinal direction, and a displacement of 2.4% or greater at 150 cN.

Effects of the Invention

According to an embodiment of the present invention, it is possible to provide tissue paper having excellent softness.

MODE FOR CARRYING OUT THE INVENTION

Figure 1:
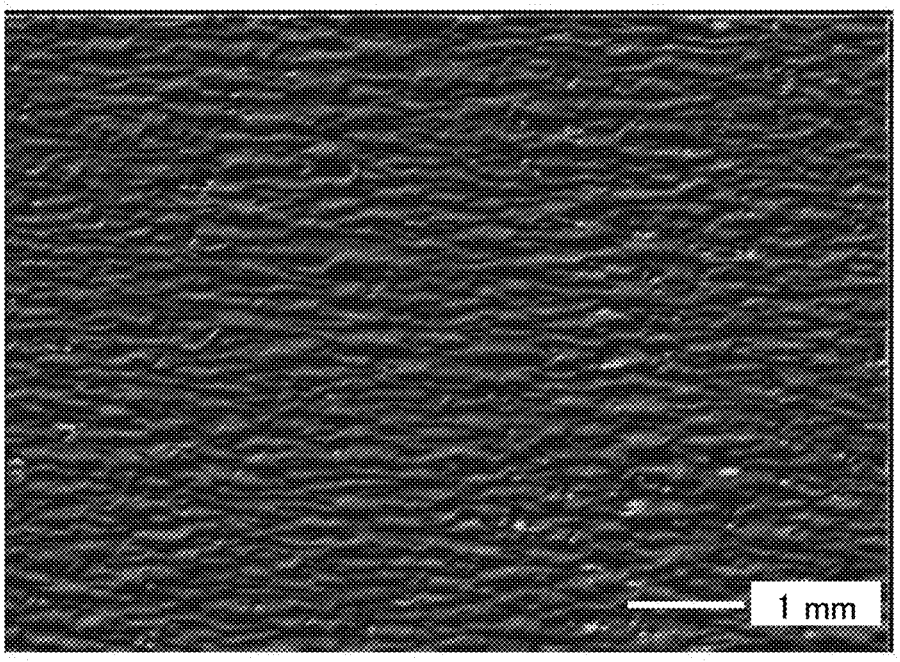
FIG. 1 is a view illustrating an image of a surface of tissue paper according to an embodiment of the present invention, measured by an image analysis.

Embodiments of the present invention will be described in detail with reference to the drawings. In the drawings, any common components will be denoted by the same reference numerals, and descriptions of such components may be skipped. In the drawings, the components may not be to scale.

<Tissue Paper>

Tissue paper according to an embodiment will be described. FIG. 1 is a view illustrating an image of a surface of the tissue paper according to the present embodiment, measured by an image analysis. In the present embodiment, the material of the tissue paper is paper. As the pulp composition of the paper, a composition that is publicly known in the field of paper may be used. For example, the pulp blend proportion may be 50% by mass or greater, preferably 90% by mass or greater, and more preferably 100% by mass.

The basis weight (also referred to as paper density) of the paper is not particularly limited, yet is, for example, 5 g/m$^2$ or greater and 80 g/m$^2$ or less, preferably 7 g/m$^2$ or greater and 50 g/m$^2$ or less, and more preferably 9 g/m$^2$ or greater and 20 g/m$^2$ or less depending on the ply rating of the tissue paper. The basis weight can be measured according to the rule of Japanese Industrial Standards (JIS) P 8124 (2011).

The thickness of the paper (hereinafter, referred to as paper thickness) is not particularly limited, yet is 50 μm or greater and 500 μm or less, preferably 60 μm or greater and 330 μm or less, and more preferably 100 μm or greater and 200 μm or less per 2 plies. The paper thickness can be measured according to the rule of JIS P 8111 (1998).

The mode of the tissue paper is not particularly limited. However, general-purpose tissue paper (tissue paper free of a moisturizing ingredient or non-moisturizing tissue paper) is preferable. The tissue paper can be applied to any of industrial use, home use, and portable use. Among these, the tissue paper is favorably used as home-use tissue paper.

The tissue paper according to the present embodiment contains a softener. In the present specification, a softener contains a component that imparts softness to the paper constituting the tissue paper. Specifically, the softener has a function of broadening the gaps between pulp fibers, and can soften the paper by making the pulp fibers be sparsely distributed by forming air layers between the pulp fibers and infiltrating also the gaps between the pulp fibers. Moreover, by adhering to the surface of the pulp, the softener can reduce rubbing against skin and impart smoothness to the paper.

The component contained in the softener is not particularly limited. Examples of the component contained in the softener include fatty acid ester-based compounds and fatty acid amide-based compounds. When using a fatty acid ester-based compound and a fatty acid amide-based compound, it is optional whether to use either one or to use both in combination. When using both, the blending ratio of the fatty acid ester-based compound to the fatty acid amide-based compound in the softener may be desirably selected. However, the content ratio of the fatty acid ester-based compound to the fatty acid amide-based compound is preferably from 1:1 through 1:5.

As the fatty acid ester-based compound contained in the softener, a compound of an alcohol containing from 6 through 24 carbon atoms and a fatty acid containing from 7 through 25 carbon atoms is preferable. The alcohol may be any selected from straight-chain alcohols, alcohols having a branched chain, saturated alcohols, and unsaturated alcohols. Particularly, alcohols containing from 10 through 22 carbon atoms are preferable, and lauryl alcohol, myristyl alcohol, cetyl alcohol, stearyl alcohol, behenyl alcohol, and oleyl alcohol are preferable.

The fatty acid containing from 7 through 25 carbon atoms may be any selected from straight-chain fatty acids, fatty acids having a branched chain, saturated fatty acids, and unsaturated fatty acids. Among these, fatty acids containing from 10 through 22 carbon atoms are preferable, and lauric acid, myristic acid, palmitic acid, stearic acid, behenic acid, and oleic acid are preferable. One of these may be used alone or two or more of these may be used in combination.

It is possible to obtain a fatty acid amide-based compound contained in the softener, by allowing polyalkylene polyamine and carboxylic acid to react. A preferable polyalkylene polyamine is one that is represented by General formula (1) below, containing at least three amino groups in a molecule.

[Math. 1]

$$H_2N-(R1-NH-)_n-R1-NH_2 \quad (1)$$

In Formula (1), each R1 independently represents an alkylene group containing from 1 through 4 carbon atoms, and n represents an integer of from 1 through 3. This polyalkylene polyamine may contain different kinds of R1 in a molecule. It is also possible to use two or more kinds of polyalkylene polyamines. A preferable R1 is an ethylene group.

Meanwhile, as the carboxylic acid, carboxylic acid containing from 10 through 24 carbon atoms is desirable, and the carboxylic acid may be any selected from saturated carboxylic acids and unsaturated carboxylic acids. Moreover, the carboxylic acid may be any selected from straight-chain carboxylic acids and carboxylic acids having a branched chain. Among these, carboxylic acids containing from 12 through 22 carbon atoms are preferable, and carboxylic acids containing from 14 through 18 carbon atoms are particularly preferable.

In the tissue paper according to the present embodiment, it is preferable that the softener contains an oil content by 0.1% by mass or greater and 0.25% by mass or less, and more preferably 0.12% by mass or greater and 0.22% by mass or less in the softener, the oil content being extractable with diethyl ether (hereinafter, the oil content may be referred to as an extractable oil content). Here, diethyl ether efficiently extracts oils and fats, which are low-polarity substances.

Typically, such an oil content (oil component) is not contained in pulp, which is the main raw material of tissue paper, but is contained in a softener. The oil content range of 0.1% by mass or greater and 0.25% by mass or less is a high range of content not found in existing tissues irrespective of the basis weight of the tissue paper.

A dry tensile strength of the tissue paper according to the present embodiment in a longitudinal direction is adjusted to 200 cN/25 mm or greater and 400 cN/25 mm or less, preferably 210 cN/25 mm or greater and 350 cN/25 mm or less, and more preferably 220 cN/25 mm or greater and 300 cN/25 mm or less.

Here, the longitudinal direction represents the flow direction of fibers (or MD direction) during a tissue paper manufacturing process. The dry tensile strength in the longitudinal direction represents strength by which the tissue paper in a dry state is pulled in the MD direction.

A dry tensile strength of the tissue paper according to the present embodiment in a transverse direction is desirably selectable, and is adjusted to, for example, 50 cN/25 mm or greater and 200 cN/25 mm or less, preferably 60 cN/25 mm or greater and 170 cN/25 mm or less, and more preferably 60 cN/25 mm or greater and 140 cN/25 mm or less.

Here, the transverse direction represents a direction (or CD direction) orthogonal to the flow direction of fibers during a tissue paper manufacturing process. The dry tensile strength in the transverse direction represents strength by which the tissue paper in a dry state is pulled in the CD direction.

A rate of elongation of the tissue paper according to the present embodiment in the longitudinal direction is desirably selectable, and is adjusted to, for example, 5% or higher and 20% or lower, preferably 8% or higher and 18% or lower, and more preferably 10% or higher and 15% or lower. Here, the rate of elongation in the longitudinal direction is the percentage representation of the length of the tissue paper at the moment the tissue paper is broken as a result of being pulled in a dry state in the flow direction of the tissue paper during the manufacturing process.

A proportional limit tensile stress of the tissue paper according to the present embodiment in the longitudinal direction is adjusted to 160 cN or greater and 250 cN or less, preferably 160 cN or greater and 240 cN or less, and yet more preferably 160 cN or greater and 230 cN or less. Here, the proportional limit tensile stress represents the maximum tensile stress in a region in which stress (tensile stress) and elongation under a tensile load are in a proportionality relation.

Figure 5:
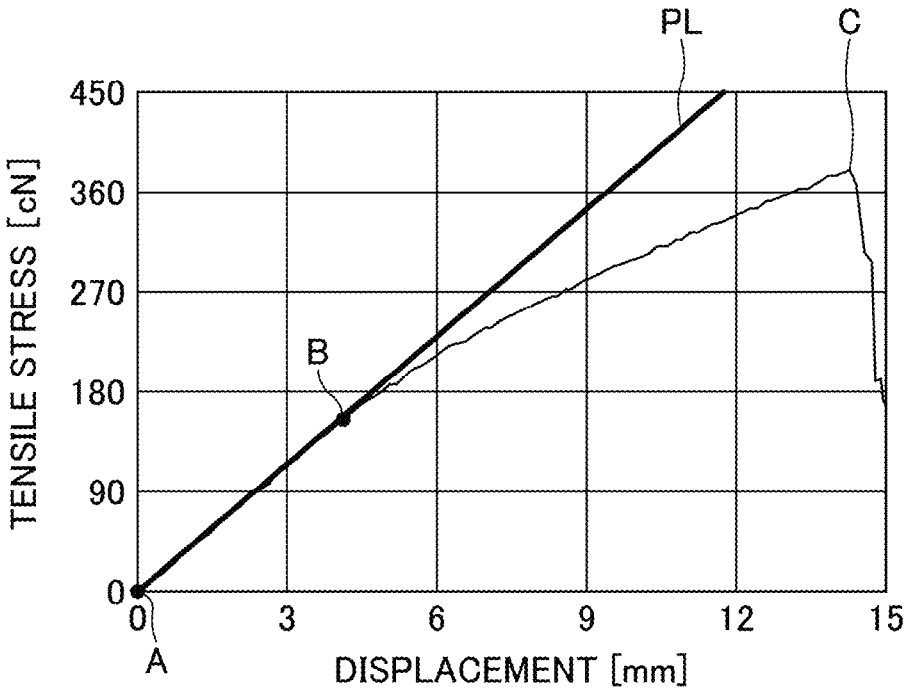
FIG. 5 is a graph plotting a relationship between displacement of tissue paper and stress in tissue paper under a tensile load.

For example, the proportional limit tensile stress is a tensile stress at a position (point B) deviating from a proportionality line PL representing a proportionality relation between displacement of the tissue paper and stress in the tissue paper under a tensile load, in the graph of FIG. 5. In FIG. 5, A represents the point (origin of displacement or point 0) at which tensile loading is started, B represents the proportional limit, and C represents a breaking point.

A proportional limit displacement rate of the tissue paper according to the present embodiment is adjusted to preferably 40% or higher, more preferably 42% or higher, and yet more preferably 45% or higher. The upper limit of the proportional limit displacement rate is not particularly limited, and may be adjusted to, for example, 70% or lower.

Here, the proportional limit displacement rate is a percentage representation of a quotient obtained for a tissue paper to which a tensile load has been applied, by dividing a displacement of the tissue paper when the tensile stress of the proportional limit has been applied by a displacement of the tissue paper from application of the tensile stress of the proportional limit until when the tissue paper is broken. The proportional limit displacement rate is calculated according to Formula (2) below.

[Math. 2]

$$\text{Proportional limit displacement rate (\%)} = \frac{\text{Displacement at proportional limit}}{\text{Displacement at breaking}} \times 100$$

Crepes are formed in the tissue paper. Until the proportional limit, elongation and shrinkage of the tissue paper are large because the crepes are elongated. On the other hand, once the proportional limit is reached, there is a tendency that elongation of entangling pulp fibers gradually saturates and elongation and shrinkage of the tissue paper become smaller, leading to breakage of the tissue paper.

From such a perspective, the proportional limit displacement rate being high indicates that the tissue paper is displaced largely until it is broken under a tensile load, and elongation and shrinkage of the tissue paper are large. Elongation and shrinkage of the tissue paper being large indicates that many crepes are formed, and that the crepes are formed minutely and uniformly to improve the surface texture.

A displacement of the tissue paper according to the present embodiment at 150 cN is adjusted to preferably 2.4% or greater, more preferably 2.5% or greater, and yet more preferably 2.6% or greater. Moreover, a displacement of the tissue paper according to the present embodiment at 250 cN is adjusted to preferably 4.5% or greater, more preferably 4.6% or greater, and yet more preferably 4.7% or greater.

Here, a displacement represents a displacement of the tissue paper when a constant load is applied to the tissue paper. A permanent displacement represents elongation that does not spring back when a constant load, which has been applied, is removed. A permanent displacement at 150 cN represents a permanent displacement at a load of 150 cN. A permanent displacement at 250 cN represents a permanent displacement at a load of 250 cN.

Figure 6:
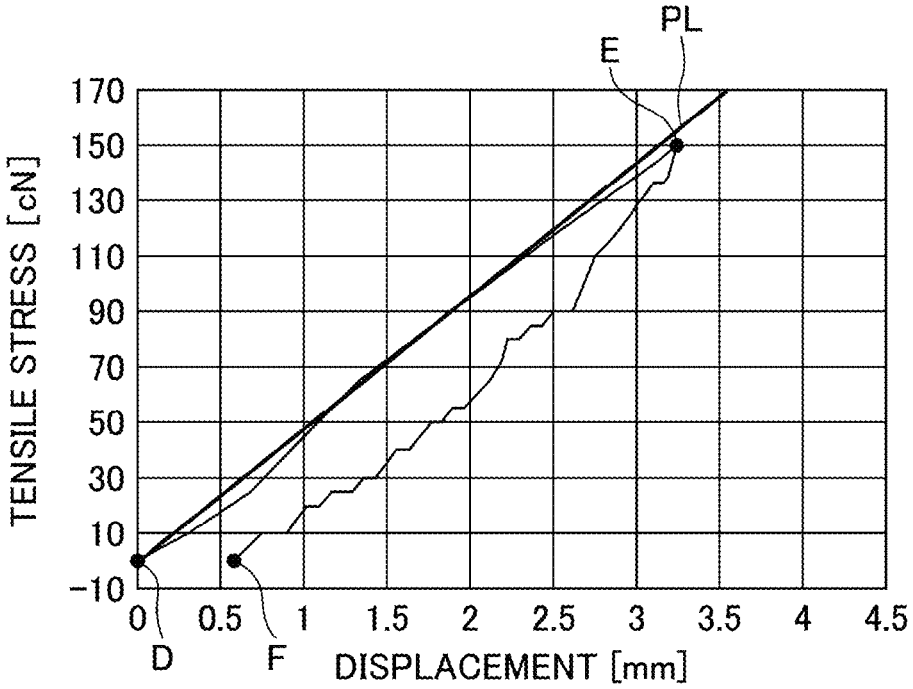
FIG. 6 is a graph plotting permanent displacement under a tensile load of 150 cN.

For example, a permanent displacement represents a displacement that does not spring back when a load of 150 cN, which has been applied, is removed in the graph of FIG. 6. In FIG. 6, D represents a point at which tensile loading is started, E represents a point of loading at 150 cN, and F on the Y axis represents a permanent displacement.

A permanent displacement rate of the tissue paper according to the present embodiment at 150 cN is preferably 21% or higher and more preferably 23% or higher. A permanent displacement rate of the tissue paper according to the present embodiment at 250 cN is preferably 30% or higher and more preferably 35% or higher.

Here, a permanent displacement rate is a percentage representation of elongation that does not spring back when a constant load, which has been applied, is removed. A permanent displacement rate at 150 cN represents a permanent displacement rate at a load of 150 cN. A permanent displacement rate at 250 cN represents a permanent displacement rate at a load of 250 cN.

The permanent displacement rate (for a permanent displacement after a constant load is removed, where the displacement when compared at the load is large) being low indicates that the tissue paper rebounds largely after being elongated, and that the tissue paper is soft.

A spherical compression work of the tissue paper according to the present embodiment is adjusted to preferably 300 mJ or lower, more preferably 290 mJ or lower, and yet more preferably 260 mJ or lower. Here, the spherical compression work represents the amount of work done when ten rolls of tissue paper, which are prepared under the same condition to have approximately the same size (each roll including paired pieces of tissue paper), are compressed in a predetermined container until their volume becomes approximately 200 ml.

The spherical compression work represents an indicator of softness when tissue paper is rolled. Specifically, the spherical compression work can be measured by a spherical compression test illustrated in FIG. 7 to FIG. 14.

Figure 7:
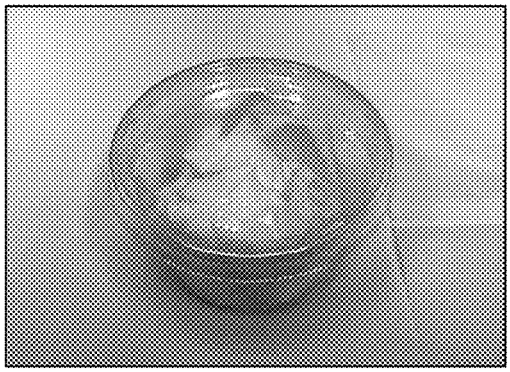
FIG. 7 is a photographic image illustrating a state in which tissue paper test specimens, which are used in a spherical compression test, are contained in a holding container.

First, one pair of pieces of tissue paper, which is humidity-controlled in a standard state in an environment according to JIS P 8111 (1998), is softly rolled on the palms of both hands so as not to be crushed, put in a 40 cc plastic container, and retained therein for 10 minutes, to manufacture a tissue paper test specimen (a roll of tissue paper or spherical tissue paper) (FIG. 7). In the present embodiment, ten such test specimens are prepared.

Figure 8:
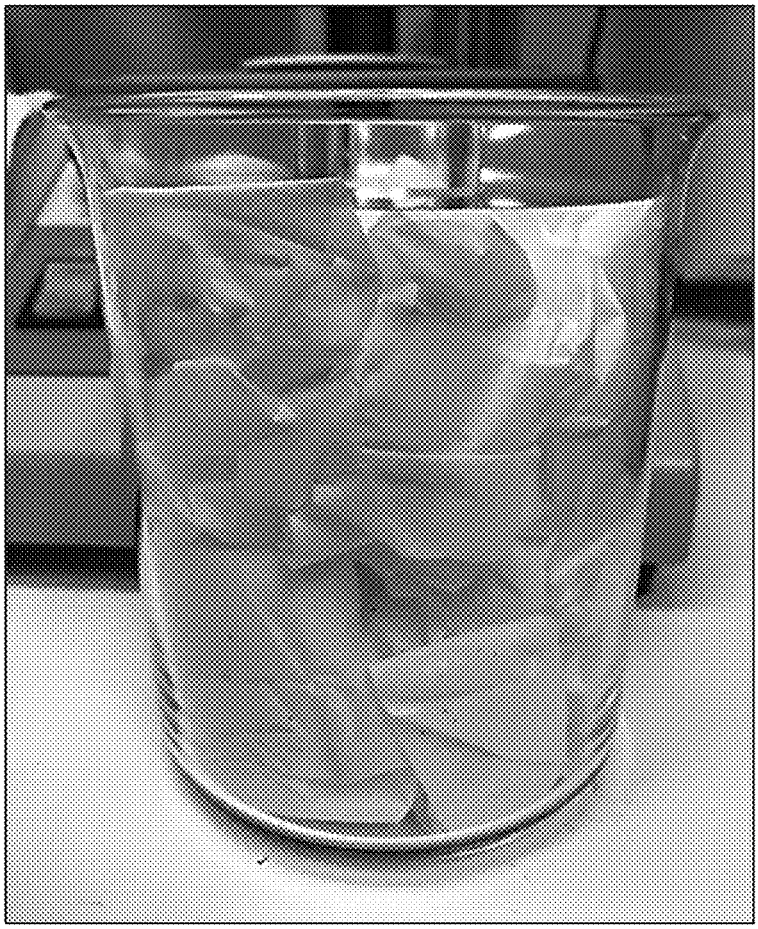
FIG. 8 is a view illustrating a state in which ten tissue paper test specimens, which are used in a spherical compression test, are contained in a testing container.
Figure 9:
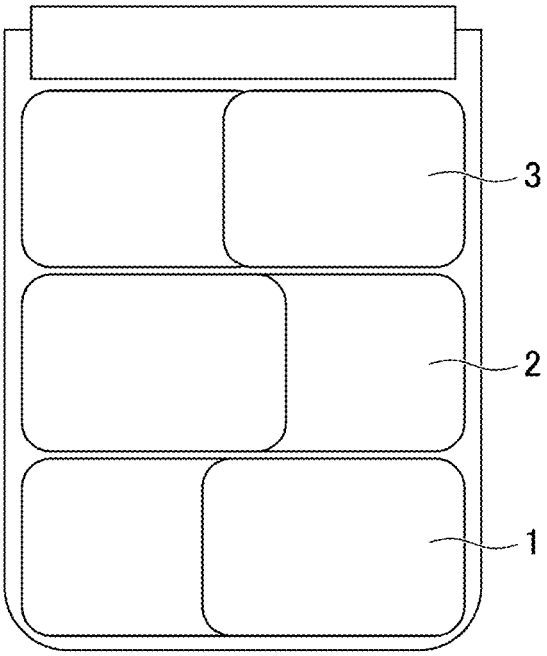
FIG. 9 is an exemplary front view of FIG. 8.
Figure 10:
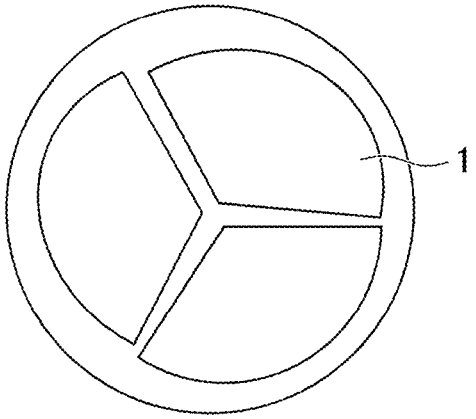
FIG. 10 is a view illustrating test specimens placed only on a lower deck in (A), test specimens placed on the lower deck and a middle deck in (B), and test specimens placed on the lower deck, the middle deck, and an upper deck in (C), the test specimens being seen when the inside of the testing container of FIG. 8 is seen from the top surface side.
Figure 10:
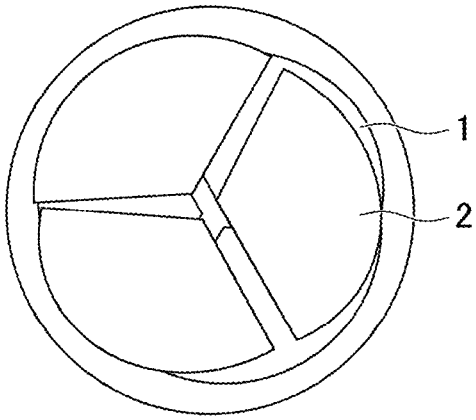
Figure 10:
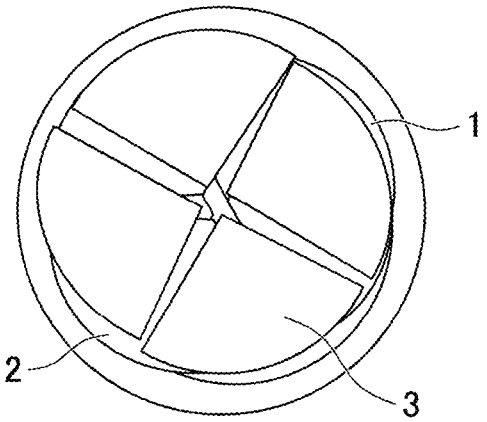

Next, the ten test specimens are put in a 500 mL glass beaker so as not to be nonuniformly distributed in the beaker (FIG. 8). Specifically, as illustrated in FIG. 9 and FIG. 10, three test specimens, three test specimens, and four test specimens (each test specimen being spherical tissue paper) are uniformly placed on the lower deck 1, the middle deck 2, and the upper deck 3 respectively, so as not to be crushed.

A disk-shaped acrylic plate (having a diameter of 82 mm, a through-hole having a diameter of 20 mm in the center, a weight of 59.5 g, and an area of 49.67 $cm^2$) is gently placed on the ten specimens of tissue paper contained in the beaker.

Figure 11:
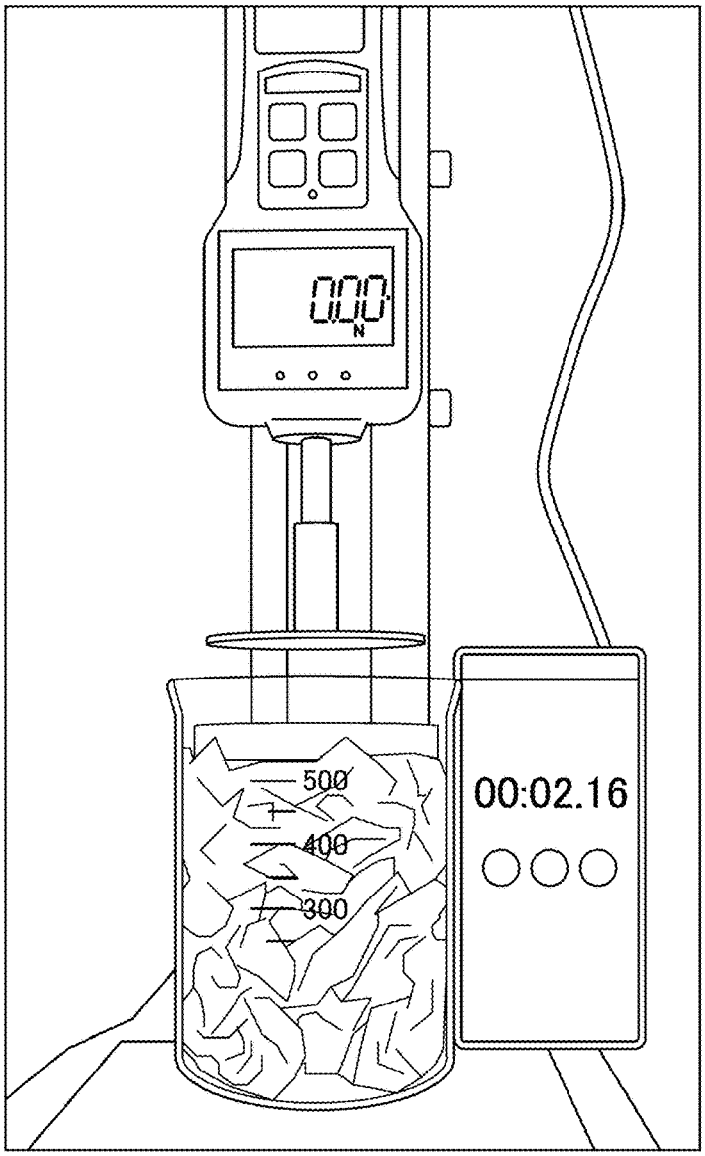
FIG. 11 is a view illustrating a state in which a testing container, in which test specimens are contained, is set on a compression tester (before start of pressurization).

The spherical compression test is started within 3 minutes from when the acrylic plate is placed. Specifically, as illustrated in FIG. 11, a timer is set on the right-hand side of the beaker in which the test specimens are contained, and a push-pull gauge (available from IMADA Co., Ltd., product name "DIGITAL FORCE GAUGE Z2-20N") is moved downward at a rate of 0.525 cm/second. The position of the end of the push-pull gauge is approximately 13.4 cm from the table on which the beaker is placed. The target goal of 200 ml is 5.0 cm from the table on which the beaker is placed.

Figure 12:
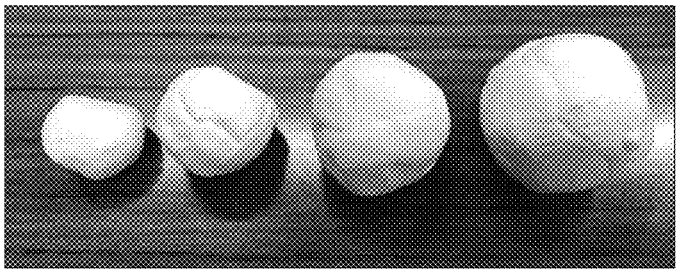
FIG. 12 is a photographic image illustrating tissue paper test specimens used in a spherical compression test (10 cc, 20 cc, 35 cc, and 50 cc from the left-hand side).

Previously, ten males and females evaluate softness of tissue paper felt when they roll it (FIG. 12). Eight out of the ten people select 20 cc as the size of the spherical tissue paper when they grasp it. Hence, 200 mL per 10 rolls is selected as the target goal.

Figure 13:
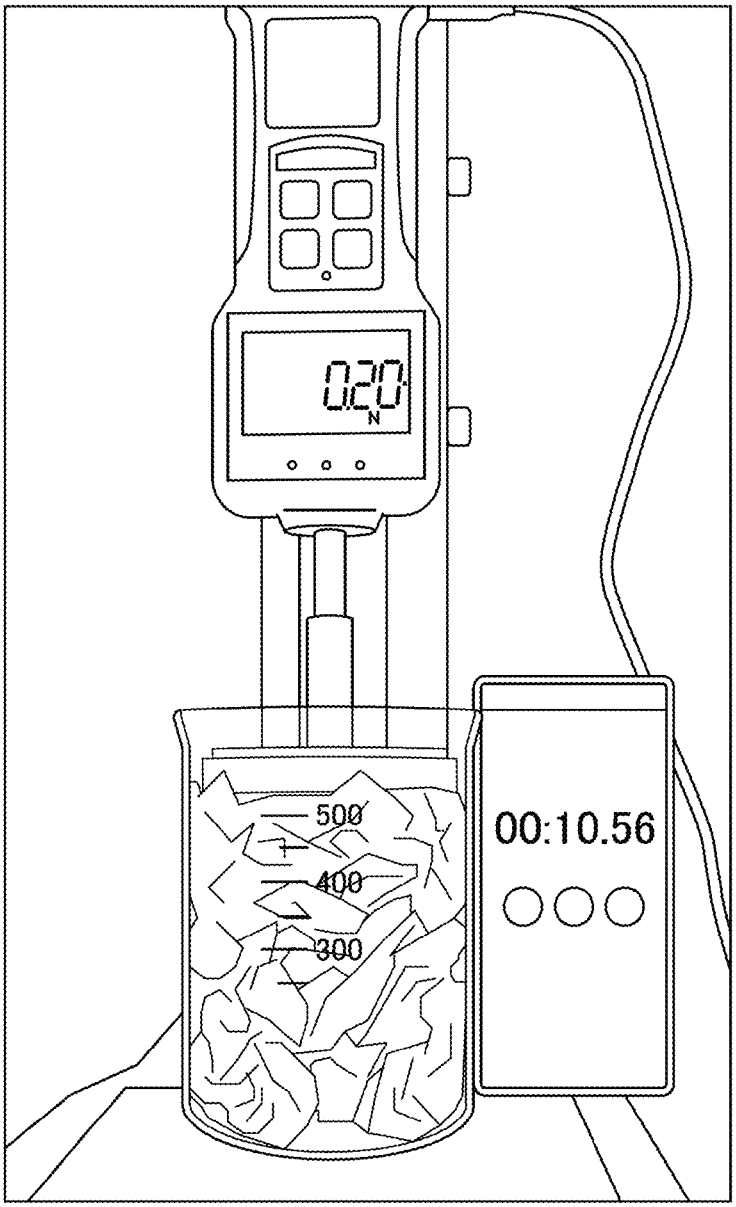
FIG. 13 is a photographic image illustrating a state when pressurization by a compression tester is started in FIG. 11.
Figure 14:
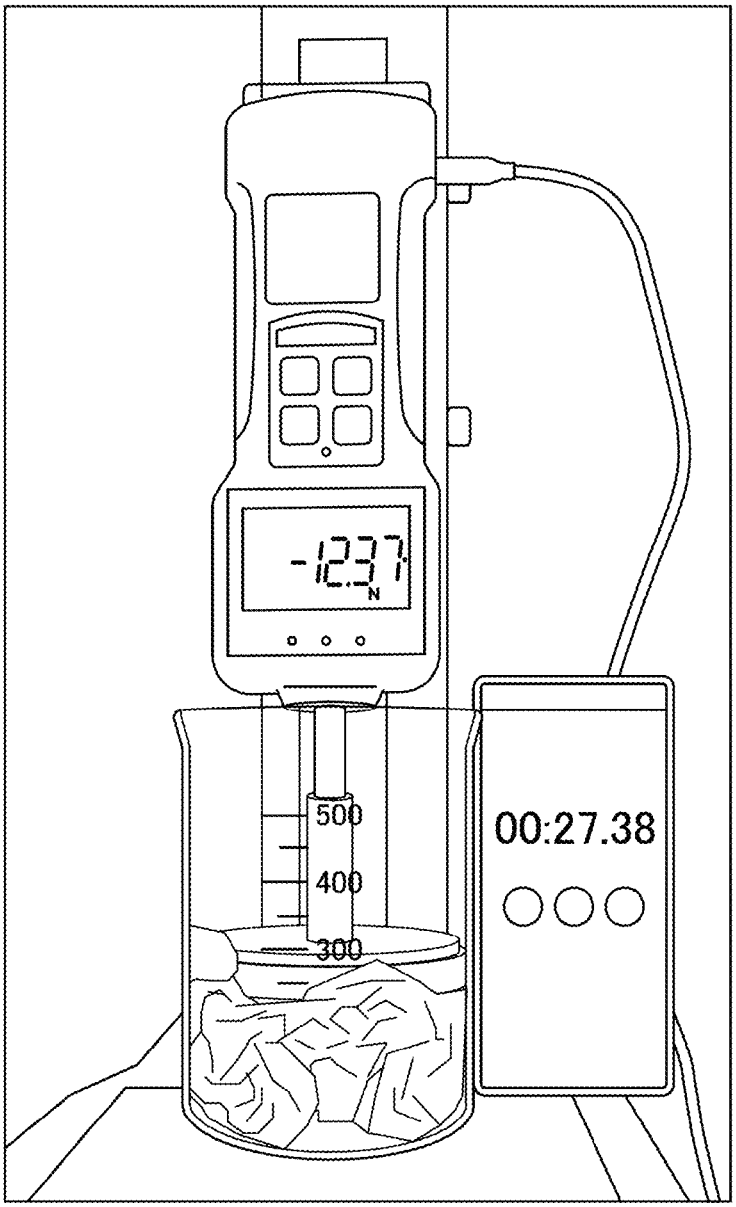
FIG. 14 is a photographic image illustrating a state during pressurization by a compression tester in FIG. 11.

In the spherical compression test, as illustrated in FIG. 13, the volume when the push-pull gauge starts pressurization upon contact on the acrylic disk plate is referred to as "initial volume". In the present embodiment, the start of loading (0.00 cN) is set at a timer indication of 10.56 seconds. The initial volume is 514.80 cc. Then, as illustrated in FIG. 14, when 200 mL is reached, the time is 21.38 seconds, and the load of the push-pull gauge is −12.37 N.

Next, the spherical compression work is calculated. The end of the push-pull gauge descends per elapse of 0.4 seconds on the timer per a pushing amount of approximately 0.20 cm. The pushing amount is assumed as $L_k$ (cm), and the pushing load is assumed as $F_k$ (kgf). $F_k$ is calculated by adding the acrylic disk plate's weight of 59.5 g to a load (N) indicated on the push-pull gauge. The spherical compression work W (mJ) is calculated according to Formula (3) below.

[Math. 3]

$$W(mJ) = \sum\{(L_k - L_{k-1}) \times 1/2 \times (F_{k-1} + F_k)\}$$

When k=1, $L_k - L_{k-1} = 0.215$ cm, $\frac{1}{2} \times (F_1 + F_2) = 0.065$ kgf, and a work W1=1 mJ are obtained according to Formula (3). Likewise, when k=2, W2=2 mJ is obtained. The sum total (spherical compression work) of the work until when 200 mL is reached from the initial volume is a work W of 260 mJ. The work W corresponds to the area below the curve in the graph illustrated in FIG. 15.

Figure 2:
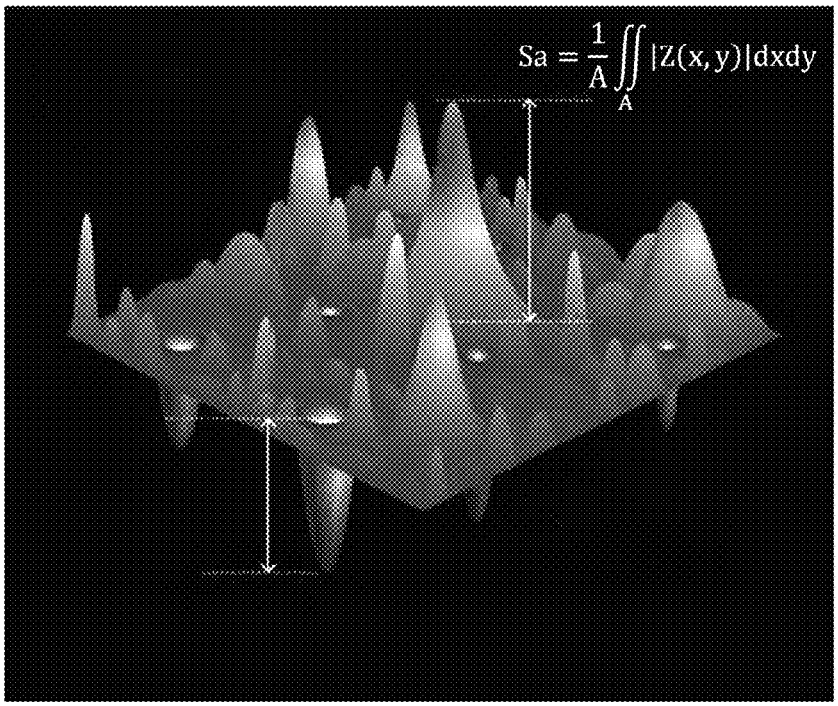
FIG. 2 is an image view for explaining arithmetic mean height.

The arithmetic mean height of the tissue paper according to the present embodiment is preferably 3 μm or greater and 7 μm or less, more preferably 4 μm or greater and 6.5 μm or less, and yet more preferably 5 μm or greater and 6 μm or less. Here, the arithmetic mean height represents the mean of the absolute values of the height differences of individual points from the mean plane of the surface (see FIG. 2).

Figure 3:
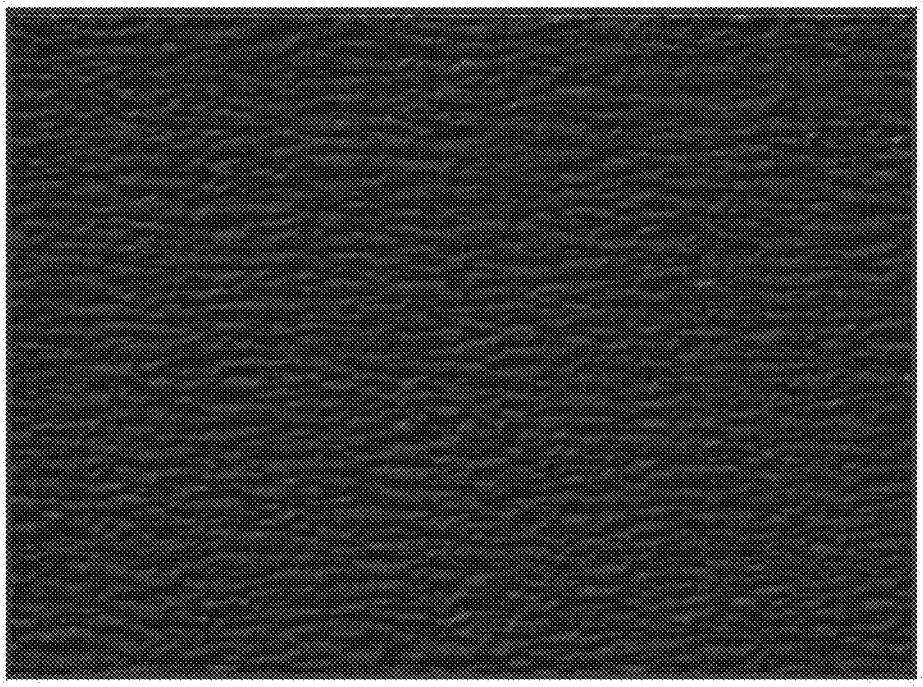
FIG. 3 is a view illustrating an image of a surface of existing tissue paper, measured by an image analysis.
Figure 4:
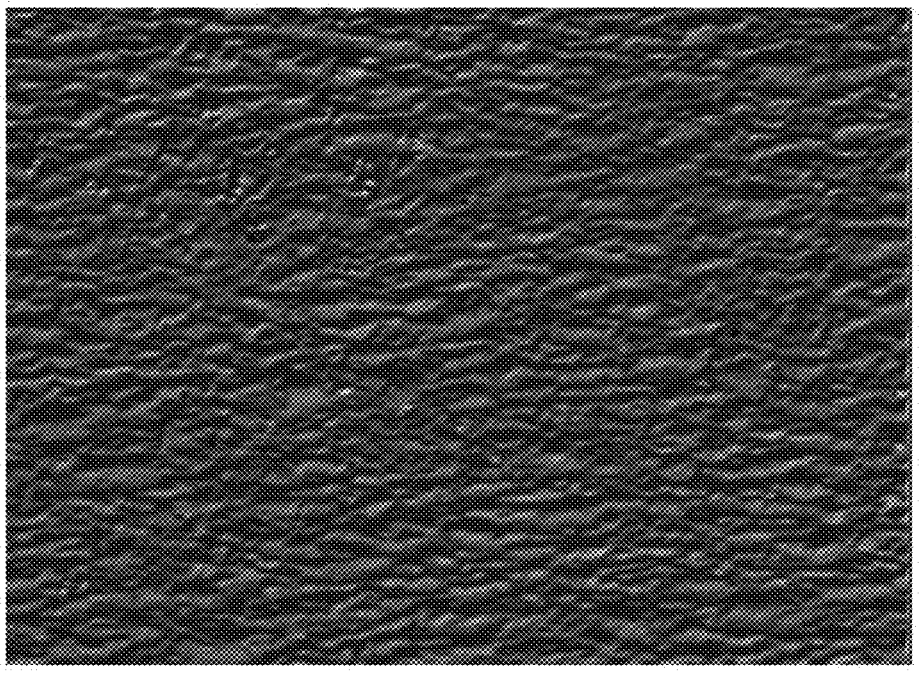
FIG. 4 is a view illustrating an image of a surface of existing tissue paper, measured by an image analysis.

Existing tissue paper has no crepes in some regions, or has a flat surface with little undulation as illustrated in FIG. 3, or has large, nonuniform crepes as illustrated in FIG. 4. Hence, existing tissue paper has a tendency of having small elongations and feeling hard, and is limited in terms of improvement of softness and smoothness.

As compared with this, the tissue paper according to the present embodiment has uniform and minute crepes as illustrated in FIG. 1, and has large elongations and feels soft. In order to obtain these effects, according to the present embodiment, on the condition that a softener is contained, the dry tensile strength in the longitudinal direction is adjusted to 200 cN/25 mm or greater and 400 cN/25 mm or less, the proportional limit tensile stress in the longitudinal direction is adjusted to 160 cN or greater and 250 cN or less, and the displacement at 150 cN is adjusted to 2.4% or greater as described above. In this way, according to the present embodiment, tissue paper that does not tear easily and has excellent softness is obtained.

By a diethyl ether-extractable oil content (softener) being contained in the tissue paper according to the present embodiment by 0.1% by mass or greater and 0.25% by mass or less as described above, it is possible to improve softness of the tissue paper.

By adjusting the permanent displacement rate of the tissue paper according to the present embodiment at 150 cN to 21% or higher as described above, it is possible to further improve softness of the tissue paper.

By adjusting the displacement of the tissue paper according to the present embodiment at 250 cN to 4.5% or greater and adjusting the permanent displacement rate of the tissue paper according to the present embodiment at 250 cN to 30% or higher and 60% or lower as described above, it is possible to further improve softness of the tissue paper.

By adjusting the spherical compression work of the tissue paper according to the present embodiment to 300 mJ or lower as described above, it is possible to further improve softness of the tissue paper.

By adjusting the arithmetic mean height of the tissue paper according to the present embodiment to 3 μm or greater and 7 μm or less as described above, it is possible to improve smoothness of the tissue paper.

<Method for Manufacturing Tissue Paper>

Figure 16:
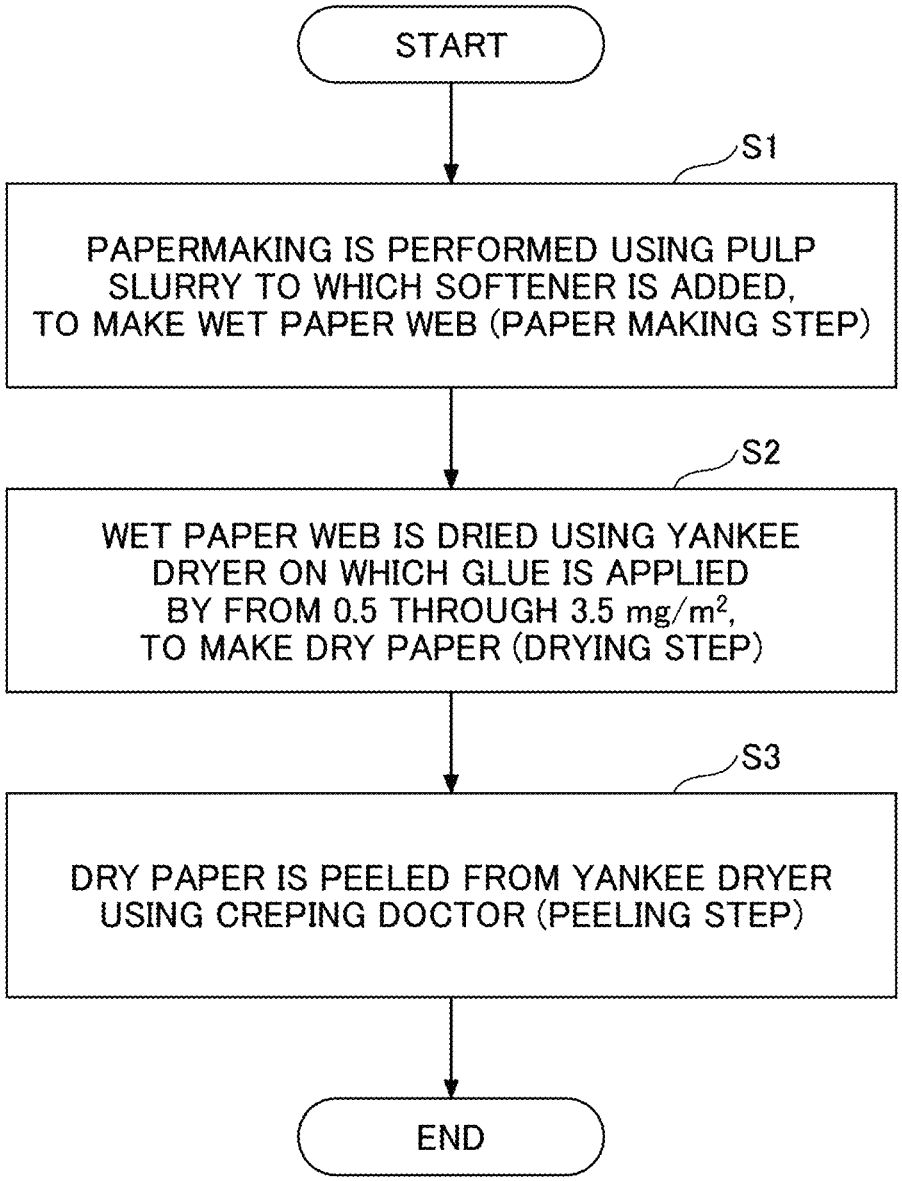
FIG. 16 is a flowchart for performing a method for manufacturing tissue paper according to an embodiment of the present invention.
Figure 17:
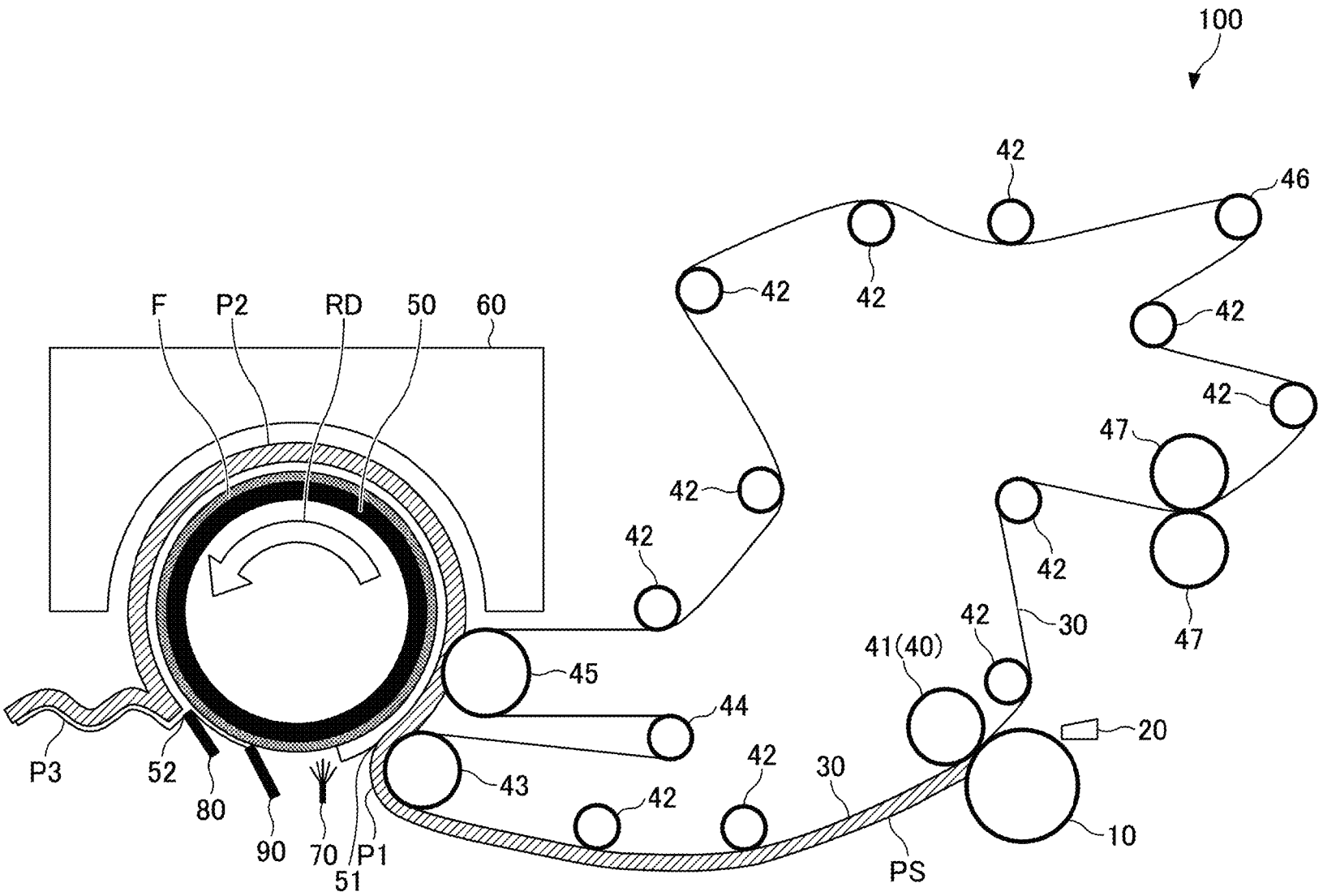
FIG. 17 is an exemplary view of an apparatus configured to manufacture tissue paper according to an embodiment of the present invention.
Figure 18:
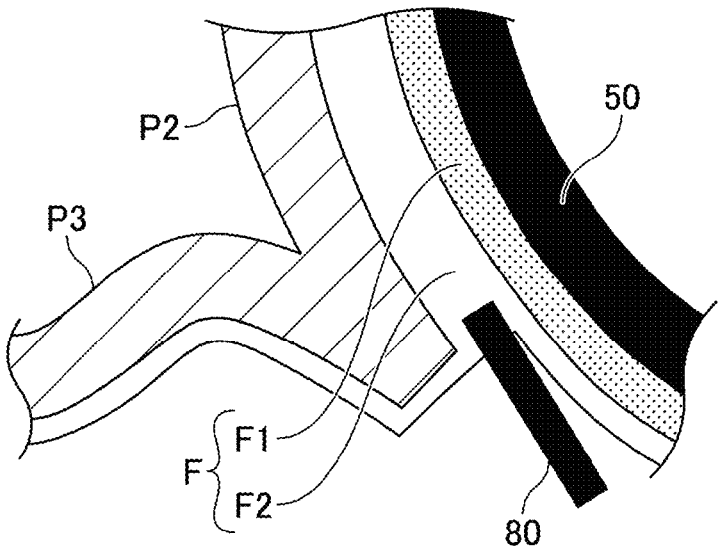
FIG. 18 is an enlarged view of a part of FIG. 17.

A method for manufacturing tissue paper according to the present embodiment will be described. FIG. 16 is a flowchart for performing the method for manufacturing tissue paper according to the present embodiment. FIG. 17 is an exemplary view of an apparatus configured to manufacture tissue paper according to the present embodiment. FIG. 18 is an enlarged view of a part of FIG. 17. In these drawings, any common components will be denoted by the same reference numerals, and descriptions of such components may be skipped.

The method for manufacturing tissue paper according to the present embodiment is a method for manufacturing the tissue paper described above, and includes a paper making step S1, a drying step S2, and a peeling step S3 (FIG. 16). The method for manufacturing tissue paper according to the present embodiment is an example of the method for manufacturing tissue paper of the present invention.

The method for manufacturing tissue paper according to the present embodiment can be realized by, for example, an apparatus 100 configured to manufacture tissue paper illustrated in FIG. 17. The apparatus 100 illustrated in FIG. 17 includes a suction cylinder 10, a pulp slurry feeding unit 20, a blanket 30, a roll 40, a yankee dryer 50, a hot air hood 60, a glue feeding unit 70, a creping doctor 80, and a cleaning doctor 90. Here, using the apparatus 100 illustrated in FIG. 17, the method for manufacturing tissue paper illustrated in FIG. 16 will be specifically described.

In the paper making step S1, papermaking is performed using a pulp slurry PS to which the softener described above is added, to make a wet paper web P1. Specifically, the Pulp slurry PS is fed from the pulp slurry feeding unit 20 to the surface of the suction cylinder 10 that is rotating. The blanket 30 having a lengthy shape is conveyed along the roll 40 (conveying rolls 42). The conveying speed of the blanket 30 is desirably selectable, and is, for example, from 900 m/minute through 1,300 m/minute.

The fed pulp slurry PS is transferred onto the blanket 30 when the blanket 30 passes between the suction cylinder 10 and a couch roll 41. The pulp slurry PS transferred onto the blanket 30 is dehydrated while being conveyed to a touch roll 43, to become the wet paper web P1.

In the drying step S2, the wet paper web P1 is dried using the yankee dryer 50, to make dry paper P2. The wet paper web P1 is separated from the blanket 30 and glued to the surface of the yankee dryer 50 when passing between the touch roll 43 rotating relatively to the yankee dryer 50 and the surface, at an entrance side 51, of the yankee dryer 50 rotating relatively to the touch roll 43.

The blanket 30, from which the wet paper web P1 is separated, is conveyed to a hitch roll 44, and then conveyed to another touch roll 45, to pass again between the touch roll 45 and the surface of the yankee dryer 50. Here, part of the wet paper web P1 that has been left remaining on the blanket 30 is glued to the surface of the yankee dryer 50.

After the wet paper web P1 is separated from the blanket 30, the blanket 30 is conveyed to a stretch roll 46, then conveyed to a squeeze roll 47 in a stretched state, and squeezed by passing the squeeze roll 47. The squeezed blanket 30 is conveyed to between the suction cylinder 10 and the couch roll 41, the pulp slurry PS is transferred, and the paper making step S1 is repeated again.

In the drying step S2, a glue is applied on the surface of the yankee dryer 50 before the wet paper web P1 passes between the touch roll 43 and the surface of the yankee dryer 50 at the entrance side 51. Specifically, the glue feeding unit 70 is provided between the entrance side 51 of the yankee dryer 50 and the cleaning doctor 90, and the glue is jetted from the glue feeding unit 70 onto the surface of the yankee dryer 50. As a result, the glue is applied on the surface of the yankee dryer 50, and a film (membrane F) of the glue is formed on the surface of the yankee dryer 50.

The component of the glue is not particularly limited, yet preferably contains a polyamide-based resin and more preferably contains a thermosetting polyamide-based resin. In the present embodiment, the glue contains a thermosetting polyamide-based resin.

In the present embodiment, the thermosetting polyamide-based resin is heated on the surface of the yankee dryer 50. Here, the thermosetting polyamide-based resin applied on the surface of the yankee dryer 50 is strongly heated near the yankee dryer 50 to make a part F1 of a membrane to be formed hard, but is weakly heated at the dry paper side apart from the yankee dryer 50 to make a part F2 of the membrane to be formed soft (FIG. 18).

The polyamide-based resin is not particularly limited. Examples of the polyamide-based resin include thermosetting polyamide-based resins such as polyamide polyamine epichlorohydrin.

By controlling epichlorohydrin modification of polyamide polyamine epichlorohydrin, it is possible to control molecular weight, crosslink density, and cationic property of the resin. Moreover, by controlling the amount of azetidinium rings (AZR) to be formed in the resin, it is possible to adjust thermosetting property. Furthermore, by adjusting thermosetting property of the thermosetting polyamide-based resin, it is possible to make the coating layer of the glue thick.

The amount of the glue to be applied on the surface of the yankee dryer 50 is 0.5 $mg/m^2$ or greater and 3.5 $mg/m^2$ or less, preferably 0.8 $mg/m^2$ or greater and 3.3 $mg/m^2$ or less, and yet more preferably 1 $mg/m^2$ or greater and 3 $mg/m^2$ or less on the surface of the yankee dryer 50.

In the present embodiment, the application amount of the glue is adjusted to from 1 kg/t through 4 kg/t relative to the mass (t) of the tissue paper P3 to be obtained. Here, the thickness of the membrane F formed on the surface of the yankee dryer 50 is estimated to be from 1 μm through 3.5 μm. The thickness of the membrane F is approximately five times greater than the thickness of an existing membrane to be formed on the surface of the yankee dryer 50 (see FIG. 18 to FIG. 21).

In the drying step S2, the wet paper web P1 passes through the hot air hood 60 in the state of being glued to the surface of the yankee dryer 50 rotating counterclockwise (RD direction), and becomes dry paper P2 by the time the wet paper web is conveyed to an exit side 52 of the yankee dryer 50.

In the peeling step S3, the dry paper P2 conveyed to the exit side 52 of the yankee dryer 50 is peeled from the yankee dryer 50 by the creping doctor 80. Specifically, with an end of the creping doctor 80 set between the yankee dryer 50 and the dry paper P2, the dry paper P2 is separated from the yankee dryer 50 while being creped.

The dry paper P2 separated from the yankee dryer 50 becomes tissue paper P3. The crepe rate of the tissue paper P3 is desirably selectable, yet is preferably from 10% through 20%.

The yankee dryer 50, from which the dry paper P2 is separated, is conveyed to the cleaning doctor 90 and cleaned. Specifically, of the membrane F remaining on the surface of the yankee dryer 50, the soft membrane F2 is scraped away by the end of the cleaning doctor 90, and only the hard membrane F1 remains on the surface of the yankee dryer 50.

On the way on which the cleaned yankee dryer 50 is conveyed to the entrance side 51 of the yankee dryer 50, the glue is applied and a membrane F formed on the surface of the yankee dryer 50 again. The yankee dryer 50, which has the membrane F formed on the surface, is conveyed to the entrance side 51, and a wet paper web P1 is glued to the surface of the yankee dryer 50 again and the drying step S2 is repeated.

Figure 19:
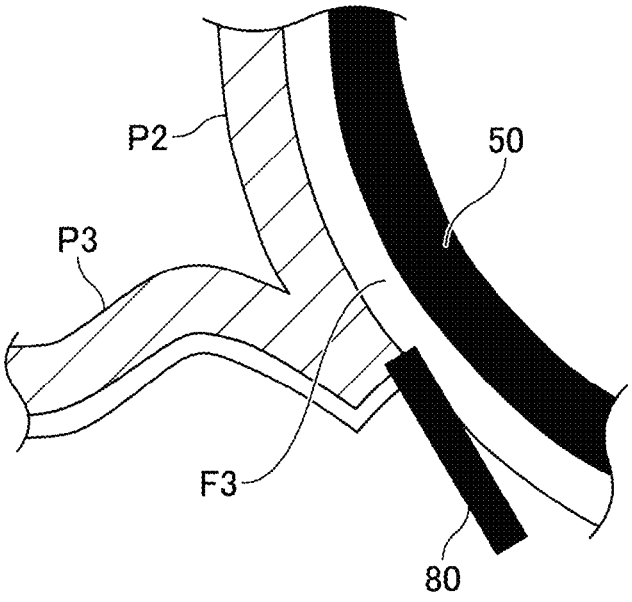
FIG. 19 is an exemplary view illustrating a part of an existing apparatus configured to manufacture tissue paper.

According to an existing method of manufacturing tissue paper, there is a case where a thin, soft membrane F3 is formed on the yankee dryer 50 (FIG. 19). According to this manufacturing method, since the membrane F3 formed on the surface of the yankee dryer 50 is thin, the end of the creping doctor 80 touches the dry paper P2 and worsens the paper quality of the surface. Moreover, as being soft, the membrane F3 easily peels from the surface of the yankee dryer 50 and makes the wet paper web P1 or the dry paper P2 insufficiently glue to the yankee dryer 50.

Figure 20:
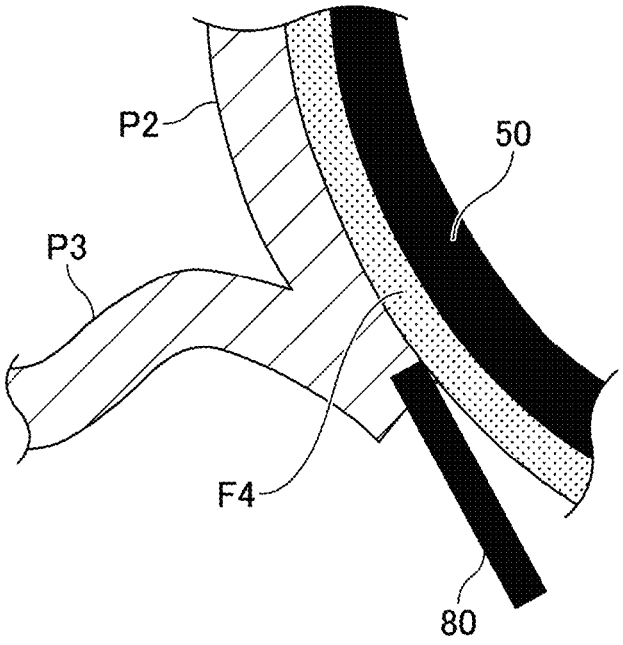
FIG. 20 is an exemplary view illustrating a part of an existing apparatus configured to manufacture tissue paper.

Moreover, according to the existing method of manufacturing tissue paper, there is a case where a thin, hard membrane F4 is formed on the yankee dryer 50 (FIG. 20). According to this manufacturing method, as peeling of the dry paper P2 occurs between the thin, hard membrane F4 and the dry paper P2, crepes become large, to worsen the surface condition and harden the paper quality.

Figure 21:
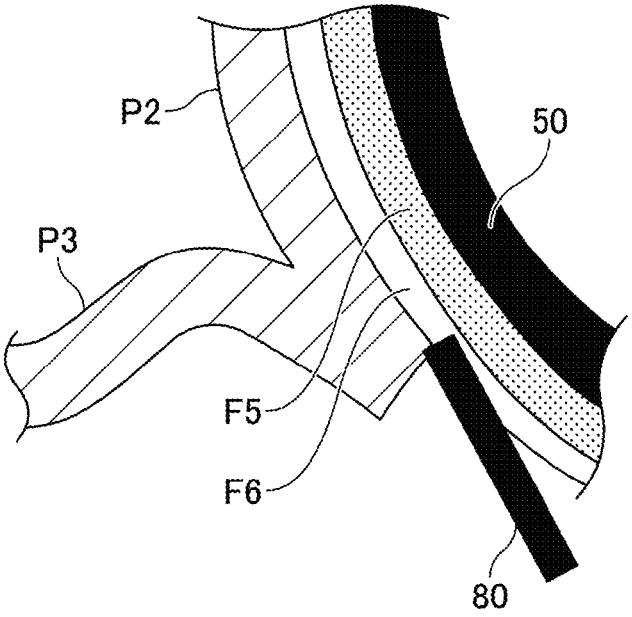
FIG. 21 is an exemplary view illustrating a part of an existing apparatus configured to manufacture tissue paper.

Moreover, according to the existing method of manufacturing tissue paper, there is a case where a hard membrane F5 and a release layer F6 are formed on the yankee dryer 50 (FIG. 21). According to this manufacturing method, the release layer F6 facilitates peeling of the dry paper P2 from the yankee dryer 50, which makes crepes small and the surface condition good, but the paper quality hard.

As compared with this, according to the manufacturing method of the present embodiment, the glue is applied on the surface of the yankee dryer 50 by 0.5 $mg/m^2$ or greater and 3.5 $mg/m^2$ or less as described above. This makes it possible to form a thick membrane F on the surface of the yankee dryer 50 (FIG. 17 and FIG. 18). Owing to this thick membrane F, the end of the creping doctor 80 bites into between the yankee dryer 50 and the dry paper P2, so the dry paper P2 is peeled while the surface of the dry paper P2 is protected by the membrane F in the peeling step S3. As a result, tissue paper having uniform and minute crepes is obtained.

According to the manufacturing method of the present embodiment, owing to the thick membrane F formed on the surface of the yankee dryer 50, the surface of the yankee dryer 50 can avoid being contacted or abutted against by the end of the creping doctor 80 in the peeling step S3. Hence, according to the manufacturing method of the present embodiment, the surface of the yankee dryer 50 can be protected by means of the thick membrane F.

According to the manufacturing method of the present embodiment, owing to the thick membrane F formed between the surface of the yankee dryer 50 and the dry paper P2, the dry paper P2 is creped via the membrane F as described above, which also makes it less likely that the end of the creping doctor 80 contacts the surface of the yankee dryer 50. Hence, in the peeling step S3, the creping doctor 80 itself can also be protected.

According to the manufacturing method of the present embodiment, a polyamide-based resin (thermosetting polyamide-based resin) is contained in the glue to be applied on the surface of the yankee dryer 50. Hence, when a thick membrane F is formed on the surface of the yankee dryer 50, a part F1 of the membrane F becomes hard due to strong heating near the yankee dryer 50, and a part F2 of the membrane F becomes soft due to weak heating at the dry paper P2 side apart from the yankee dryer 50.

Hence, according to the manufacturing method of the present embodiment, the soft membrane F2 formed on the surface of the Yankee dryer 50 facilitates gluing of the dry paper P2 and pickup of the dry paper P2 (gluing of the wet paper web P1 to the yankee dryer 50) in the drying step S2. Moreover, the hard membrane F1 formed on the surface of the yankee dryer 50 can enhance protection of the surface of the yankee dryer 50.

EXAMPLES

The present invention will be specifically described below by way of Examples. Evaluations of Examples and Comparative Examples were performed by the tests described below.

[Tissue Paper (Test Specimen)]

Tissue paper was manufactured by the manufacturing method of FIG. 16 (the apparatus 100 of FIG. 17), and used as test specimens.

[Surface Roughness (Arithmetic Mean Height)]

Surface roughness was measured using a one-shot 3D measuring macroscope VR-3200 and image analyzing software "VR-H2A" obtained from Keyence Corporation. Measurement was performed at a magnification of ×12 with a field of view area of 30 mm×30 mm. Arithmetic mean height was calculated from the obtained surface roughness. The arithmetic mean height was obtained as the mean of the absolute values of the height differences of individual points from the mean plane of the surface.

[Basis Weight (Paper Density)]

The basis weight (paper density) of the tissue paper was measured according to the rule of JIS P 8124. The unit of the basis weight was $g/m^2$.

[Thickness (Paper Thickness)]

The thickness of the tissue paper was measured according to the rule of JIS P 8111 (1998). The unit of the thickness was μm.

[Dry Tensile Strength]

Dry tensile strength was measured according to the rule of JIS P 8113 (1998). As the test pieces, those that were cut to have a width of approximately 25 mm (±0.5 mm) in either of the longitudinal direction and the transverse direction and a length of approximately 150 mm in the other of the longitudinal direction and the transverse direction were used. As the tester, a tensile compression tester (obtained from Minebea Co., Ltd., TG-200N) was used. Measurement was performed according to the procedure of setting the free length of the test piece between grips to 100 mm, fastening both ends of the test piece to the grips of the tester, applying a tensile load to the paper piece of the tissue paper in the vertical direction, and reading the indicated value (digital value) when the tissue paper would be broken. The tensile speed was set to 100 mm/min. Five specimens (each was a paired specimen) were prepared for each of the longitudinal direction and the transverse direction, and the measurement was performed five times in each direction. The average of the measured values was obtained as the dry tensile strength in each direction. The longitudinal-transverse ratio was calculated as the ratio of the tensile strength in the longitudinal direction to the tensile strength in the transverse direction.

[Rate of Elongation]

Rate of elongation in the longitudinal direction was measured using a tensile compression tester (obtained from Minebea Co., Ltd., TG-200N). Rate of elongation was expressed as a percentage of the length by which the tissue paper elongated until when it was broken in response to application of a tensile load.

[Proportional Limit]

Using a tensile compression tester (obtained from MinebeaMitsumi Inc., TECHNOGRAPH TGE SERIES), tissue paper having a width of 25 mm (in the transverse direction of the tissue paper) and a length of 140 mm (in the longitudinal direction of the tissue paper) was set between chucks having a gap of 100 mm therebetween, and pulled at a rate of 100 mm/minute until the tissue paper would be broken. Here, the tensile load test was started by making the tissue paper sag by a length of approximately 5 mm in the longitudinal direction, and the point at which stress would start to be accumulated was set as the origin of displacement. The proportional limit tensile stress was the maximum tensile stress in the region in which tensile stress and elongation were in a proportionality relation. Proportional limit displacement rate was calculated according to Formula (2) above based on displacement at proportional limit and displacement at breaking.

[Permanent Displacement]

Using a tensile compression tester (obtained from MinebeaMitsumi Inc., TECHNOGRAPH TGE SERIES), tissue paper having a width of 25 mm was set between chucks having a gap of 100 mm therebetween, and pulled at a rate of 100 mm/minute until 150 cN and 250 cN. Subsequently, the tissue paper was released from the load, and displacement of the tissue paper was measured at a rate of 20 mm/minute until the elongated tissue paper would completely rebound. When the elongated tissue paper completely rebounded, the test was terminated. The tensile strength of non-moisturizing tissue paper in the longitudinal direction is approximately from 250 cN through 450 cN, and 150 cN is within the proportional limit and 250 cN is beyond the proportional limit. Hence, data at these two loads were measured.

[Spherical Compression Test]

Tissue paper (one pair) that was humidity-controlled in a standard state in an environment according to JIS P 8111

Figure 15:
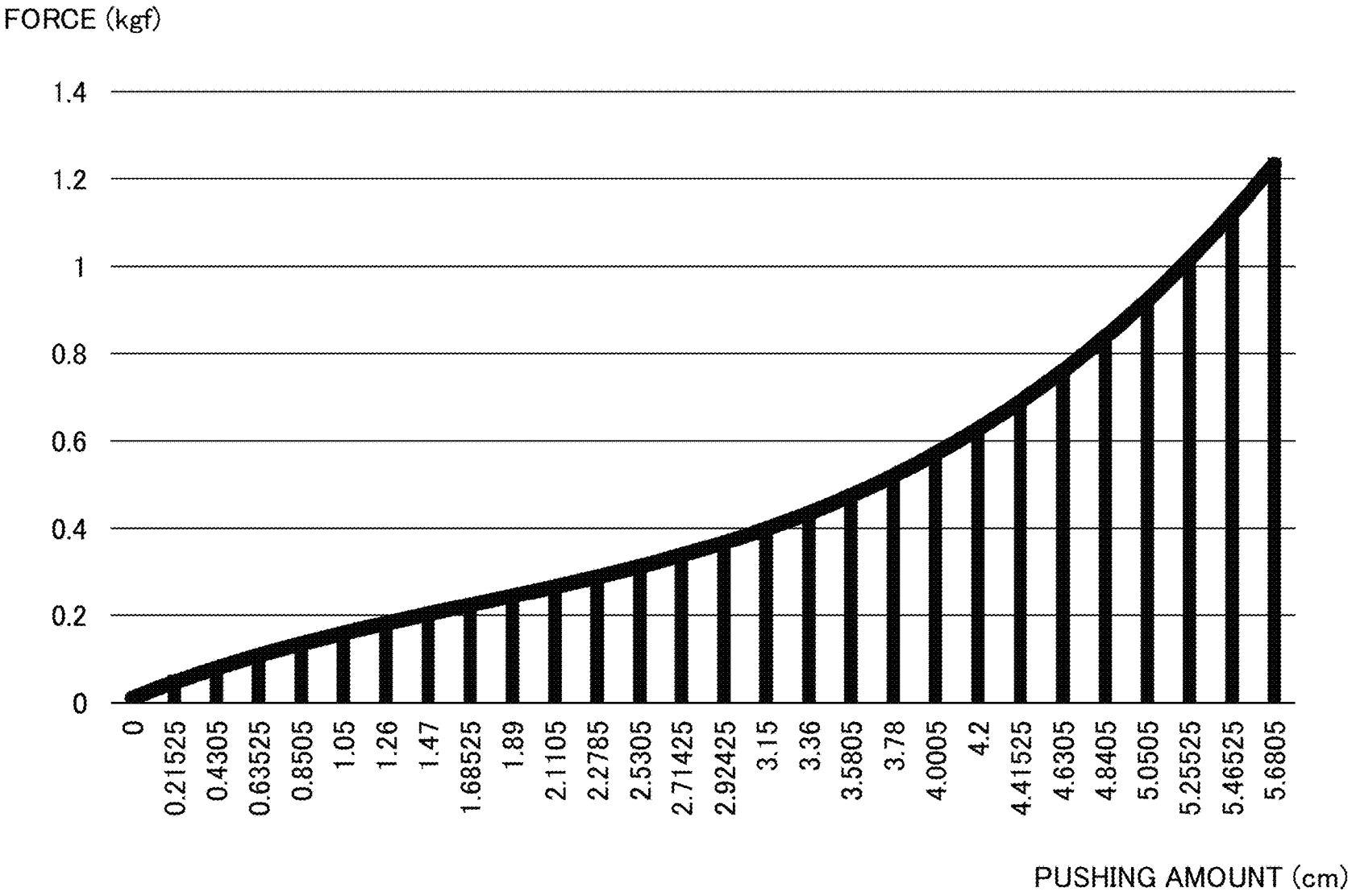
FIG. 15 is a graph plotting a relationship between pressure (force) and volume under pressurization (pushing amount) in a spherical compression test.

(1998) was softly rolled on the palms of both hands so as not to be crushed, put in a 40 cc plastic container, and retained therein for 10 minutes, to manufacture a tissue paper test specimen (a roll of tissue paper or spherical tissue paper). Ten such test specimens were manufactured (FIG. 7). The manufactured ten test specimens were put in a 500 mL glass beaker. Here, of the test specimens, three were placed on a lower deck 1, three on a middle deck 2, and four on an upper deck 3 so as not to be crushed in the beaker (FIG. 9 and FIG. 10). A disk-shaped acrylic plate (having a diameter of 82 mm, a through-hole having a diameter of 20 mm in the center, a weight of 59.5 g, and an area of 49.67 $cm^2$) was gently placed on the ten specimens of tissue paper contained in the beaker. The spherical compression test was started within 3 minutes from when the acrylic plate was placed. In the spherical compression test, a timer was set on the right-hand side of the beaker in which the test specimens were contained, and a push-pull gauge (obtained from IMADA Co., Ltd., product name "DIGITAL FORCE GAUGE Z2-20N") was moved downward at a rate of 0.525 cm/second (FIG. 11). The position of the end of the push-pull gauge was approximately 13.4 cm from the table on which the beaker was placed. The target goal of 200 ml was 5.0 cm from the table on which the beaker was placed. Previously, ten males and females evaluated softness of tissue paper felt when they rolled it (FIG. 12). Eight out of the ten persons selected 20 cc as the size of the spherical tissue paper when they grasped it. Hence, 200 mL per 10 rolls was selected as the target goal. Next, the volume when the push-pull gauge started pressurization upon contact on the acrylic disk plate was regarded as "initial volume". In the present embodiment, the start of loading (0.00 cN) was set at a timer indication of 10.56 seconds. The initial volume was 514.80 cc (FIG. 13). Then, as illustrated in FIG. 14, when 200 mL was reached, the time was 21.38 seconds, and the load of the push-pull gauge was −12.37 N (FIG. 14). Next, the spherical compression work was calculated. The end of the push-pull gauge would descend per elapse of 0.4 seconds on the timer per a pushing amount of approximately 0.20 cm. The pushing amount was assumed as $L_k$ (cm), and the pushing load was assumed as $F_k$ (kgf). $F_k$ was calculated by adding the acrylic disk plate's weight of 59.5 g to a load (N) indicated on the push-pull gauge. The spherical compression work W (mJ) was calculated according to Formula (3) above. When k=1, $L_k-L_{k-1}=0.215$ cm, $\frac{1}{2}\times(F_1+F_2)=0.065$ kgf, and a work W1=1 mJ were obtained according to Formula (3). Likewise, when k=2, W2=2 mJ was obtained. The sum total of the work until when 200 mL was reached from the initial volume was a work W of 260 mJ. The work W corresponds to the area below the curve (FIG. 15).

[Extractable Oil Content]

A test specimen was immersed in diethyl ether, and the amount of the oil content to be extracted (extractable oil content) was calculated as a ratio to the weight of the tissue paper.

[Sensory Test]

Softness, moist feeling, smoothness, and thickness feeling were each and comprehensively evaluated. For the comprehensive evaluation, the average of the scores of softness, moist feeling, smoothness, and thickness feeling was calculated. When the comprehensive evaluation was 4.5 or greater, the test specimen was evaluated as good.

Examples and Comparative Examples will be described below.

Example 1

A test specimen that was adjusted to an arithmetic mean height of 5.5 μm, a basis weight of 12.1 g/$m^2$, a paper thickness of 126 μm, a dry tensile strength (longitudinal) of 281 cN, a dry tensile strength (transverse) of 97 cN, a rate of elongation (longitudinal) of 8.9%, a proportional limit tensile stress of 205 cN in the longitudinal direction, a proportional limit displacement of 4.3%, a proportional limit displacement rate of 48%, a displacement of 3.3% at 150 cN, a permanent displacement of 0.9% at 150 cN, a permanent displacement rate of 26% at 150 cN, a displacement of 4.9% at 250 cN, a permanent displacement of 1.8% at 250 cN, a permanent displacement rate of 37% at 250 cN, an initial volume of 515 ml in the spherical compression test, a spherical compression work of 260 mJ, and an extractable oil content of 0.13% was evaluated. The results are presented in Table 1.

Example 2

A test specimen that was adjusted to an arithmetic mean height of 3.9 μm, a basis weight of 12.1 g/$m^2$, a paper thickness of 123 μm, a dry tensile strength (longitudinal) of 312 cN, a dry tensile strength (transverse) of 136 cN, a rate of elongation (longitudinal) of 6.6%, a proportional limit tensile stress of 228 cN in the longitudinal direction, a proportional limit displacement of 3.2%, a proportional limit displacement rate of 48%, a displacement of 2.6% at 150 cN, a permanent displacement of 0.6% at 150 cN, a permanent displacement rate of 23% at 150 cN, a displacement of 5.6% at 250 cN, a permanent displacement of 2.2% at 250 cN, a permanent displacement rate of 39% at 250 cN, an initial volume of 566 ml in the spherical compression test, a spherical compression work of 257 mJ, and an extractable oil content of 0.12% was evaluated. The results are presented in Table 1.

Example 3

A test specimen that was adjusted to an arithmetic mean height of 4.4 μm, a basis weight of 12.0 g/$m^2$, a paper thickness of 130 μm, a dry tensile strength (longitudinal) of 247 cN, a dry tensile strength (transverse) of 130 cN, a rate of elongation (longitudinal) of 8.4%, a proportional limit tensile stress of 178 cN in the longitudinal direction, a proportional limit displacement of 5.2%, a proportional limit displacement rate of 62%, a displacement of 4.7% at 150 cN, a permanent displacement of 1.7% at 150 cN, a permanent displacement rate of 37% at 150 cN, an initial volume of 500 ml in the spherical compression test, a spherical compression work of 222 mJ, and an extractable oil content of 0.18% was evaluated. The results are presented in Table 1.

Example 4

A test specimen that was adjusted to an arithmetic mean height of 6.1 μm, a basis weight of 15 g/$m^2$, a paper thickness of 170 μm, a dry tensile strength (longitudinal) of 258 cN, a dry tensile strength (transverse) of 80 cN, a rate of elongation (longitudinal) of 14.9%, a proportional limit tensile stress of 169 cN in the longitudinal direction, a proportional limit displacement of 9.0%, a proportional limit displacement rate of 60%, a displacement of 7.9% at 150 cN, a permanent displacement of 3.3% at 150 cN, a permanent displacement rate of 42% at 150 cN, a displacement of 13.6% at 250 cN, a permanent displacement of 7.9% at 250 cN, a permanent displacement rate of 58% at 250 cN, an initial volume of 517 ml in the spherical compression test, a spherical compression work of 257 mJ, and an extractable oil content of 0.22% was evaluated. The results are presented in Table 1.

Comparative Example 1

A test specimen that was adjusted to an arithmetic mean height of 3.4 μm, a basis weight of 12.0 g/m$^2$, a paper thickness of 120 μm, a dry tensile strength (longitudinal) of 272 cN, a dry tensile strength (transverse) of 123 cN, a rate of elongation (longitudinal) of 5.6%, a proportional limit tensile stress of 170 cN in the longitudinal direction, a proportional limit displacement of 2.7°, a proportional limit displacement rate of 48%, a displacement of 2.1% at 150 cN, a permanent displacement of 0.4% at 150 cN, a permanent displacement rate of 20% at 150 cN, a displacement of 3.7% at 250 cN, a permanent displacement of 1.0% at 250 cN, a permanent displacement rate of 27% at 250 cN, an initial volume of 585 ml in the spherical compression test, a spherical compression work of 339 mJ, and an extractable oil content of 0.10% was evaluated. The results are presented in Table 1.

Comparative Example 2

A test specimen that was adjusted to an arithmetic mean height of 7.2 μm, a basis weight of 13.4 g/m$^2$, a paper thickness of 140 μm, a dry tensile strength (longitudinal) of 317 cN, a dry tensile strength (transverse) of 115 cN, a rate of elongation (longitudinal) of 14.3%, a proportional limit tensile stress of 155 cN in the longitudinal direction, a proportional limit displacement of 4.0%, a proportional limit displacement rate of 28%, a displacement of 4.2% at 150 cN, a permanent displacement of 1.3% at 150 cN, a permanent displacement rate of 30% at 150 cN, a displacement of 8.1% at 250 cN, a permanent displacement of 3.9% at 250 cN, a permanent displacement rate of 48% at 250 cN, an initial volume of 561 ml in the spherical compression test, a spherical compression work of 292 mJ, and an extractable oil content of 0.05% was evaluated. The results are presented in Table 1.

Comparative Example 3

A test specimen that was adjusted to an arithmetic mean height of 5.7 μm, a basis weight of 13.1 g/m$^2$, a paper thickness of 136 μm, a dry tensile strength (longitudinal) of 268 cN, a dry tensile strength (transverse) of 139 cN, a rate of elongation (longitudinal) of 12.2%, a proportional limit tensile stress of 167 cN in the longitudinal direction, a proportional limit displacement of 6.6%, a proportional limit displacement rate of 55%, a displacement of 6.4% at 150 cN, a permanent displacement of 1.6% at 150 cN, a permanent displacement rate of 26% at 150 cN, a displacement of 10.7% at 250 cN, a permanent displacement of 5.6% at 250 cN, a permanent displacement rate of 53% at 250 cN, an initial volume of 576 ml in the spherical compression test, a spherical compression work of 306 mJ, and an extractable oil content of 0.12% was evaluated. The results are presented in Table 1.

Comparative Example 4

A test specimen that was adjusted to an arithmetic mean height of 4.7 μm, a basis weight of 10.7 g/m$^2$, a paper thickness of 113 μm, a dry tensile strength (longitudinal) of 464 cN, a dry tensile strength (transverse) of 130 cN, a rate of elongation (longitudinal) of 8.8%, a proportional limit tensile stress of 260 cN in the longitudinal direction, a proportional limit displacement of 4.0%, a proportional limit displacement rate of 46%, a displacement of 2.6% at 150 cN, a permanent displacement of 0.7% at 150 cN, a permanent displacement rate of 26% at 150 cN, a displacement of 3.9% at 250 cN, a permanent displacement of 1.0% at 250 cN, a permanent displacement rate of 26° at 250 cN, an initial volume of 572 ml in the spherical compression test, and a spherical compression work of 266 mJ was evaluated. The results are presented in Table 1.

Comparative Example 5

A test specimen that was adjusted to an arithmetic mean height of 6.2 μm, a basis weight of 11.4 g/m$^2$, a paper thickness of 123 μm, a dry tensile strength (longitudinal) of 520 cN, a dry tensile strength (transverse) of 130 cN, a rate of elongation (longitudinal) of 11.0%, a proportional limit tensile stress of 226 cN in the longitudinal direction, a proportional limit displacement of 3.7%, a proportional limit displacement rate of 33%, a displacement of 2.9% at 150 cN, a permanent displacement of 1.0% at 150 cN, a permanent displacement rate of 35° at 150 cN, a displacement of 4.0% at 250 cN, a permanent displacement of 1.4% at 250 cN, a permanent displacement rate of 36% at 250 cN, an initial volume of 565 ml in the spherical compression test, and a spherical compression work of 267 mJ was evaluated. The results are presented in Table 1.

TABLE 1

| | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 |
|---|---|---|---|---|---|---|---|---|---|---|
| Surface roughness | Sa arithmetic mean height (μm) | 5.5 | 3.9 | 4.4 | 6.1 | 3.4 | 7.2 | 5.7 | 4.7 | 6.2 |
| Paper quality | Basis weight (g/m$^2$) | 12.1 | 12.1 | 12.0 | 15.0 | 12.0 | 13.4 | 13.1 | 10.7 | 11.4 |
| | Paper thickness (μm) | 126 | 123 | 130 | 170 | 120 | 140 | 136 | 115 | 123 |
| | Dry tensile strength Longitudinal (cN) | 281 | 312 | 247 | 258 | 232 | 317 | 268 | 464 | 520 |
| | Dry tensile strength transverse (cN) | 97 | 136 | 130 | 80 | 123 | 115 | 139 | 130 | 330 |
| | Rate of elongation longitudinal (%) | 8.9 | 6.6 | 8.4 | 14.9 | 5.6 | 14.3 | 12.2 | 8.8 | 11.0 |
| | Extractable oil content (%) | 0.13 | 0.12 | 0.18 | 0.22 | 0.10 | 0.05 | 0.12 | — | — |

TABLE 1-continued

| | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 |
|---|---|---|---|---|---|---|---|---|---|---|
| Proportional limit | Proportional limit tensile stress (cN) | 205 | 228 | 178 | 169 | 170 | 155 | 167 | 260 | 226 |
| | Proportional limit displacement (%) | 4.3 | 3.2 | 5.2 | 9.0 | 2.7 | 4.0 | 6.6 | 4.0 | 3.7 |
| | Proportional limit displacement rate (%) | 48 | 48 | 62 | 60 | 48 | 28 | 55 | 46 | 33 |
| Permanent displacement | Displacement (%) at 150 cN | 3.3 | 2.6 | 4.7 | 7.9 | 2.1 | 4.2 | 6.4 | 2.6 | 2.9 |
| | Permanent dispacement (%) at 150 cN | 0.9 | 0.6 | 1.7 | 3.3 | 0.4 | 1.3 | 1.6 | 0.7 | 1.0 |
| | Permanent displacement rate (%) at 150 cN | 26 | 23 | 37 | 42 | 20 | 30 | 26 | 26 | 35 |
| | Displacement (%) at 250 cN | 4.9 | 5.6 | — | 13.6 | 3.7 | 8.1 | 10.7 | 3.9 | 4.0 |
| | Permanent dispacement (%) at 250 cN | 1.8 | 2.2 | — | 7.9 | 1.0 | 3.9 | 5.6 | 1.0 | 1.4 |
| | Permanent displacement rate (%) at 250 cN | 37 | 39 | — | 58 | 27 | 48 | 53 | 26 | 36 |
| Spherical compression test | Initial volume (ml) | 515 | 566 | 500 | 517 | 585 | 561 | 576 | 572 | 565 |
| | Spherical compression work (mJ) | 260 | 257 | 222 | 257 | 339 | 292 | 306 | 266 | 267 |
| Sensory evaluation | Softness | 4.9 | 4.6 | 4.9 | 4.8 | 4.2 | 4.0 | 4.2 | 4.1 | 3.7 |
| | Moist feeling | 4.8 | 4.4 | 4.8 | 4.4 | 4.2 | 4.0 | 4.0 | 3.7 | 3.4 |
| | Smoothness | 5.2 | 4.7 | 5.3 | 4.5 | 5.1 | 4.0 | 4.5 | 4.3 | 3.5 |
| | Thickness feeling | 3.9 | 4.1 | 4.1 | 5.2 | 4.3 | 4.0 | 4.4 | 3.7 | 3.8 |
| | Comprehensive evaluation | 5.1 | 4.5 | 5.1 | 5.2 | 4.3 | 4.0 | 4.2 | 3.8 | 3.5 |

From Table 1, tissue paper that was adjusted to an arithmetic mean height of from 3.9 μm through 6.1 μm, a basis weight of from 12 g/m$^2$ through 15 g/m$^2$, a paper thickness of from 123 μm through 170 μm, a dry tensile strength (longitudinal) of from 247 cN through 312 cN, a dry tensile strength (transverse) of from 80 cN through 136 cN, a rate of elongation (longitudinal) of from 6.6% through 14.9%, a proportional limit tensile stress of from 169 cN through 228 cN in the longitudinal direction, a proportional limit displacement of from 3.2% through 9%, a proportional limit displacement rate of from 48% through 62%, a displacement of from 2.6% through 7.9% at 150 cN, a permanent displacement of from 0.6% through 3.3% at 150 cN, a permanent displacement rate of from 23% through 42% at 150 cN, an initial volume of from 500 ml through 566 ml in the spherical compression test, a spherical compression work of from 222 mJ through 260 mJ, and an extractable oil content of from 0.12% through 0.22% was given a comprehensive evaluation of 4.5 or greater (Examples 1 to 4).

As compared with this, tissue paper having an arithmetic mean height, a dry tensile strength (longitudinal), a rate of elongation (longitudinal), a proportional limit tensile stress in the longitudinal direction, a proportional limit displacement, a proportional limit displacement rate, a displacement at 150 cN, a permanent displacement at 150 cN, a permanent displacement rate at 150 cN, an initial volume in the spherical compression test, and a spherical compression work, at least any of which fell out of the ranges of Examples 1 to 4, was given a comprehensive evaluation of lower than 4.5 (Comparative Examples 1 to 5).

An embodiment of the present invention has been described above. However, the present invention is not limited to the specific embodiment, but various modifications and changes can be made within the scope of the invention described in the claims.

Preferred aspects of the present invention will be described in the following.

According to a first aspect of the present invention, tissue paper containing a softener, and having a dry tensile strength of 200 cN/25 mm or greater and 400 cN/25 mm or less in a longitudinal direction, a proportional limit tensile stress of 160 cN or greater and 250 cN or less in the longitudinal direction, and a displacement of 2.4% or greater at 150 cN is provided.

In the present specification, the softener contains a component that imparts softness to paper that constitutes tissue paper. The longitudinal direction represents the flow direction of fibers (or MD direction) during a tissue paper manufacturing process.

The dry tensile strength represents strength by which the tissue paper in a dry state is pulled. Proportional limit tensile stress represents the maximum tensile stress in a region in which stress (tensile stress) and elongation under a tensile load are in a proportionality relation. 150 cN represents a tensile strength of the tissue paper within the proportional limit. A displacement at 150 cN represents a displacement of the tissue paper when a constant load of 150 cN is applied to the tissue paper in the longitudinal direction.

According to the first aspect, on the condition that a softener is contained, the dry tensile strength in the longitudinal direction is adjusted to 200 cN/25 mm or greater and 400 cN/25 mm or less, the proportional limit tensile stress in the longitudinal direction is adjusted to 160 cN or greater and 250 cN or less, and the displacement at 150 cN is adjusted to 2.4% or greater. In this way, tissue paper that does not tear easily and has excellent softness is obtained.

According to a second aspect of the present invention, tissue paper, in which the softener contains a diethyl ether-extractable oil content by 0.1% by mass or greater and 0.25% by mass or less in the softener, is provided. According to the second aspect, it is possible to improve softness of tissue paper by making the tissue paper contain a softener that contains a diethyl ether-extractable oil content by 0.1% by mass or greater and 0.25% by mass or less in the softener.

According to a third aspect of the present invention, tissue paper having a permanent displacement rate of 21% or higher at 150 cN is provided. In the present specification, permanent displacement represents elongation that does not spring back when a constant load, which has been applied, is removed. A permanent displacement rate is a percentage representation of elongation that does not spring back when a constant load, which has been applied, is removed. A permanent displacement rate at 150 cN represents a permanent displacement rate at a load of 150 cN.

The permanent displacement rate represents that tissue paper that has a large displacement when compared at a constant load and a small permanent displacement when the load is removed rebounds largely after being elongated and is soft. According to the third aspect, by adjusting the permanent displacement rate at 150 cN to 21% or higher, it is possible to further improve softness of the tissue paper.

According to a fourth aspect of the present invention, tissue paper having a displacement of 4.5% or greater at 250 cN and a permanent displacement rate of 30% or higher and 60% or lower at 250 cN is provided. In the present specification, 250 cN represents a tensile strength of the tissue paper beyond the proportional limit. A displacement at 250 cN represents a displacement of the tissue paper when a constant load of 250 cN is applied to the tissue paper in the longitudinal direction. A permanent displacement rate at 250 cN represents a permanent displacement rate at a load of 250 cN.

According to the fourth aspect, by adjusting the displacement at 250 cN to 4.5% or greater and adjusting the permanent displacement rate at 250 cN to 30% or higher and 60% or lower, it is possible to further improve softness of the tissue paper.

According to a fifth aspect of the present invention, tissue paper having a spherical compression work of 300 mJ or lower is provided. In the present specification, spherical compression work represents the amount of work done when ten rolls of tissue paper, which are prepared under the same condition to have approximately the same size (each roll including a pair of pieces of tissue paper), are compressed in a predetermined container until their volume becomes approximately 200 ml.

The spherical compression work represents an indicator of softness when tissue paper is rolled. According to the fifth aspect, by adjusting the spherical compression work to 300 mJ or lower, it is possible to further improve softness of the tissue paper.

According to a sixth aspect of the present invention, tissue paper having an arithmetic mean height of 3 μm or greater and 7 μm or less is provided. According to the sixth aspect, by adjusting the arithmetic mean height to 3 μm or greater and 7 μm or less, it is possible to improve smoothness of the tissue paper.

According to a seventh aspect of the present invention, a method for manufacturing the tissue paper of any of the first to sixth aspects described above, including a paper making step of performing papermaking using a pulp slurry to which the softener is added, to make a wet paper web, a drying step of drying the wet paper web using a yankee dryer, to make dry paper, and a peeling step of peeling the dry paper from the yankee dryer using a creping doctor, where a glue is applied on the surface of the yankee dryer by 0.5 $mg/m^2$ or greater and 3.5 $mg/m^2$ or less, is provided.

According to the seventh aspect, it is possible to form a thick membrane on the surface of the yankee dryer, since the glue is applied on the surface of the yankee dryer by 0.5 $mg/m^2$ or greater and 3.5 $mg/m^2$ or less. In the peeling step, owing to this thick membrane, an end of the creping doctor bites into between the yankee dryer and the dry paper, so the dry paper is peeled while the surface of the dry paper is protected by the membrane. As a result, tissue paper having uniform and minute crepes is obtained.

According to the seventh aspect, owing to the thick membrane formed on the surface of the yankee dryer, the surface of the yankee dryer can avoid being contacted by the end of the creping doctor in the peeling step. Therefore, according to the seventh aspect, the surface of the yankee dryer can be protected by the thick membrane.

Moreover, according to the seventh aspect, owing to the thick membrane formed between the surface of the yankee dryer and the dry paper, the dry paper is creped via the membrane as described above, and the yankee dryer itself can also be protected in the peeling step because it is less likely that the end of the creping doctor contacts the surface of the yankee dryer.

According to an eighth aspect of the present invention, a method for manufacturing tissue paper, wherein the glue contains a polyamide-based resin, is provided. In the process in which a thick membrane is to be formed on the surface of the yankee dryer, a polyamide-based resin contained in the glue applied on the surface of the yankee dryer makes a part of the membrane hard near the yankee dryer due to strong heating, and makes a part of the membrane soft at the dry paper side apart from the yankee dryer due to weak heating.

Hence, according to the eighth aspect, the soft membrane formed on the surface of the yankee dryer facilitates gluing of the dry paper and pickup of the dry paper (gluing of the wet paper web to the yankee dryer) in the drying step. Moreover, the hard membrane formed on the surface of the yankee dryer can enhance protection of the surface of the yankee dryer.

The present application claims priority based on the Japanese patent application No. 2021-93671 filed on Jun. 3, 2021, the entire contents of which are incorporated herein by reference.

DESCRIPTION OF THE REFERENCE NUMERALS

1: lower deck
2: middle deck
3: upper deck
100: apparatus
10: suction cylinder
20: pulp slurry feeding unit
30: blanket
40: roll
41: couch roll
42: conveying roll
43: touch roll
44: hitch roll
45: touch roll
46: stretch roll
47: squeeze roll
50: yankee dryer
51: entrance side
52: exit side
60: hot air hood
70: glue feeding unit
80: creping doctor
90: cleaning doctor
PS: pulp slurry
P1: wet paper web
P2: dry paper
P3: tissue paper
F F1, F2, F3, F4, F3, F6: membrane
MD: longitudinal direction (flow direction of tissue paper)
CD: transverse direction (direction orthogonal to flow direction of tissue paper)

The invention claimed is:

1. A tissue paper comprising a softener, wherein the tissue paper exhibits:

dry tensile strength of 200 cN/25 mm or greater and 400 cN/25 mm or less in a longitudinal direction;

a proportional limit tensile stress of 160 cN or greater and 250 cN or less in the longitudinal direction; and displacement of 2.4% or greater at 150 cN, wherein displacement is measured by:

setting a 25 mm-wide strip of the tissue paper between two opposing chucks spaced 100 mm apart on a tensile tester;

pulling the tissue paper at a rate of 100 mm/minute until reaching 150 cN;

releasing the tissue paper from the load; and measuring displacement of the tissue paper at a rate of 20 mm/minute until the tissue paper completely rebounds; and wherein the softener contains an oil content by 0.1% by mass or greater and 0.25% by mass or less in the softener, the oil content being extractable with diethyl ether, the tissue paper is produced by:

forming, on a surface of a yankee dryer, a coating film having a thickness of 1 μm to 3.5 μm on the surface by applying a glue onto the surface in an amount of 1 kg to 4 kg per ton of the tissue paper; and creping the tissue paper from the surface.

2. The tissue paper according to claim 1, wherein the tissue paper exhibits permanent displacement rate of 21% or higher at 150 cN.

3. The tissue paper according to claim 1, wherein the tissue paper exhibits displacement of 4.5% or greater at 250 cN, and permanent displacement rate of 30% or higher and 60% or lower at 250 cN.

4. The tissue paper according to claim 1, wherein the tissue paper exhibits spherical compression work of 300 mJ or lower.

5. The tissue paper according to claim 1, wherein the tissue paper exhibits arithmetic mean height of 3 μm or greater and 7 μm or less.

6. A method for manufacturing tissue paper, the method comprising:

performing papermaking using a pulp slurry to which a softener is added, to make a wet paper web, the softener having an oil content by 0.1% by mass or greater and 0.25% by mass or less in the softener, the oil content being extractable with diethyl ether;

forming, on a surface of a yankee dryer, a coating film having a thickness of 1 μm to 3.5 μm on the surface by applying a glue onto the surface in an amount of 1 kg to 4 kg per ton of tissue paper;

drying the wet paper web using the yankee dryer, to make tissue paper; and creping the tissue paper from the yankee dryer using a creping doctor.

7. The method for manufacturing the tissue paper according to claim 6, wherein the glue contains a polyamide-based resin.

* * * * *